US005614356A

United States Patent [19]

Nii et al.

[11] Patent Number: 5,614,356

[45] Date of Patent: Mar. 25, 1997

[54] COLOR DEVELOPING AGENT, PROCESSING COMPOSITION AND COLOR IMAGE-FORMING METHOD

[75] Inventors: Kazumi Nii; Kiyoshi Morimoto, both of Minami-ashigara, Japan

[73] Assignee: Fuji Photo Film Co., Ltd., Minami-ashigara, Japan

[21] Appl. No.: 458,652

[22] Filed: Jun. 2, 1995

[30] Foreign Application Priority Data

Jun. 8, 1994 [JP] Japan ..... 6-148778

[51] Int. Cl.[6] ..... G03C 7/413

[52] U.S. Cl. ..... 430/442; 430/484; 430/467

[58] Field of Search ..... 430/442, 484, 430/467

[56] References Cited

U.S. PATENT DOCUMENTS

| | | | |
|---|---|---|---|
| 2,304,953 | 12/1942 | Peterson | 430/384 |
| 4,898,807 | 2/1990 | Kobayashi et al. | 430/467 |
| 5,328,812 | 7/1994 | Haijima et al. | 430/442 |
| 5,380,625 | 1/1995 | Mihayashi et al. | 430/442 |

FOREIGN PATENT DOCUMENTS

| | | |
|---|---|---|
| 53-69035 | 6/1978 | Japan . |
| 5-113653 | 5/1993 | Japan . |
| 5-232654 | 9/1993 | Japan . |

*Primary Examiner*—Mark F. Huff

*Attorney, Agent, or Firm*—Burns, Doane, Swecker & Mathis, LLP

[57] ABSTRACT

A method for forming a color image comprises the step of developing an image-wise exposed silver halide color photographic photosensitive material at the presence of the following color developing agent or its analogue. According to this method, the rapid process can be attained, causing only a slight deterioration of the developer with time and capable of sufficiently exhibiting high yellow and cyan densities to achieve an excellent color balance.

(D-5)

(D-18)

17 Claims, No Drawings

COLOR DEVELOPING AGENT, PROCESSING COMPOSITION AND COLOR IMAGE-FORMING METHOD

BACKGROUND OF THE INVENTION

The present invention relates to a new silver halide developing agent for color photographic materials, a composition of a processing solution containing the developing agent, and a method for forming a color image with the processing solution. In particular, the present invention relates to a developing agent for color photographic materials suitable for rapid processing of color photographs while keeping the processing solution from deterioration, a processing solution containing the developing agent, and a method for forming a color image with the processing solution.

As mini-labs for processing photosensitive materials within the shops and the amount of color negative films used in the field of news photos are increasing recently, the demand for completion of the development process in a shorter time to immediately provide the prints to the customers or to immediately place the photo in newspapers or the like is rapidly increasing. The demand for reduction of the processing time is becoming more and more eager in processing color negative films, since the time necessitated therefor is longer than that necessitated for processing color papers.

The reduction in the processing time is possible by changing the color developing agent in a color photographic photosensitive materials mainly comprising a silver bromoiodide emulsion such as color negative films. It was found that the processing time can be remarkably reduced by introducing a methoxy group into 2-position to form 4-(N-ethyl-N-δ-hydroxybutylamino)-2-methoxylaniline as described in Japanese Patent Unexamined Published Application (hereinafter referred to as "J. P. KOKAI") No. Hei 5-113635 or 4-(N-ethyl-N-β-hydroxyethylamino)-2-methoxyaniline as described in J. P. KOKAI No. Sho 53-69035. It was also found that the processing time can be reduced with a developing agent having a water-soluble group-containing alkoxy group at the 2-position such as 2-(hydroxyethoxy)-4-diethylaminoaniline as described in U.S. Pat. No. 2,304,953.

However, it was found when a photosensitive material for color photography which mainly comprises a silver bromoiodide emulsion is developed with one of the compounds described in these specifications, a problem, i.e. a low resistance of the developer to oxidation with air, is caused. After testing the deterioration of various 4-(N,N-dialkylamino)-2-alkoxyanilines with time, it was found that the resistance to oxidation with air can be improved by replacing the group at the 2-position with isopropoxy group to form, for example, 4-[N,N-bis(δ-hydroxybutyl)amino]-2-isopropoxyaniline as described in J. P. KOKAI No. Hei 5-232654, or by replacing the group at the 2-position with t-butoxy group to form, for example, 4-(N-methyl-N-γ-hydroxypropylamino)-2-t-butoxyaniline.

However, these two compounds described in J. P. KOKAI No. Hei 5-232654 capable of reducing the deterioration of the developer with time are yet unsatisfactory, since sufficient yellow density and cyan density are not easily obtained, though a high magenta density can be obtained.

SUMMARY OF THE INVENTION

The present invention has been completed under these circumstances.

A primary object of the invention is to provide a color developing agent suitable for use in the rapid processing method, causing only a slight deterioration of the developer with time and capable of sufficiently exhibiting high yellow and cyan densities to achieve an excellent color balance.

Another object of the invention is to provide a processing solution containing the developing agent and used for processing a silver halide color photographic photosensitive materials.

Another object of the invention is to provide a method for forming a color image in a short period of time, causing only a slight deterioration of the developer with time and capable of sufficiently exhibiting high yellow and cyan densities to achieve an excellent color balance.

These and other objects of the invention will be apparent from the following description and Examples.

The above-described objects have been solved by use of a color developing agent represented by the following general formula (D): general formula (D):

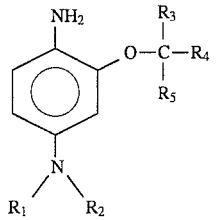

wherein $R_1$ and $R_2$ each represent an alkyl group, $R_3$, $R_4$ and $R_5$ may be the same or different from one another and each represent a hydrogen atom or substituent, with the proviso that at least two of $R_3$, $R_4$ and $R_5$ each represent an alkyl, aryl, heterocyclic, carboxyl, acyl or carbamoyl group, $R_1$, $R_2$, $R_3$, $R_4$ and $R_5$ may be substituted and are substituted with at least one hydroxyl group, when the number of the hydroxyl group is one, the total carbon atoms in $R_1$ through $R_5$ is 4 to 6; when the number of the hydroxyl groups is two, the number of the total carbon atoms in $R_1$ through $R_5$ is 4 to 9; and when the number of the hydroxyl groups is three to six, the number of the total carbon atoms in $R_1$ through $R_5$ is 4 to 20.

Description of the Preferred Embodiments

The detailed description will be made on $R_1$, $R_2$, $R_3$, $R_4$ and $R_5$ in the compound of the above general formula (D) used in the present invention.

$R_1$ and $R_2$ may be the same or different from each other and each represent an alkyl group which may have a substituent. The substituents are, for example, halogen atoms, alkyl, aryl, heterocyclic, cyano, nitro, hydroxy, carboxyl, sulfo, alkoxy, aryloxy, acylamino, amino, alkylamino, anilino, ureido, sulfamoylamino, alkylthio, arylthio, alkoxycarbonylamino, sulfonamido, carbamoyl, sulfamoyl, sulfonyl, alkoxycarbonyl, heterocyclic-oxy, azo, acyloxy, carbamoyloxy, silyl, silyloxy, aryloxycarbonylamino, imido, heterocyclic-thio, sulfinyl, phosphonyl, aryloxycarbonyl and acyl groups. These groups may be substituted with an alkyl, alkenyl, alkynyl, aryl, hydroxy, nitro or cyano group, a halogen atom, or a substituent comprising an oxygen, nitrogen, sulfur or carbon atom.

The detailed description will be made on examples of the substituents. The halogen atoms include, for example, fluorine and chlorine atoms. The alkyl groups include, for example, linear, branched or cyclic alkyl groups having 1 to 7 carbon atoms, preferably 1 to 4 carbon atoms, such as methyl, ethyl, n-propyl, isopropyl, t-butyl, n-pentyl, hydroxymethyl, 2-hydroxyethyl, 3-hydroxypropyl, benzyl, methanesulfonamidomethyl, 2-methanesulfonamidoethyl, 3-methanesulfonamidopropyl, 2-methanesulfonylethyl, methoxymethyl, 2-methoxyethyl, acetoamidomethyl, 2-acetoamidoethyl, carboxymethyl, 2-carboxyethyl, sulfomethyl, 2-sulfoethyl, carbamoylmethyl, 2-carbamoylethyl, 3-carbamoylpropyl, 2,3-dihydroxypropyl, 3,4-dihydroxybutyl, 2-hydroxypropyl, 4-hydroxybutyl, 2-carbamoylaminoethyl, carbamoylaminomethyl, 3-carbamoylaminopropyl, 4-carbamoylaminobutyl, 4-carbamoylbutyl, 2-carbamoyl-l-methylethyl and 4-nitrobutyl groups.

The aryl groups include those having 6 or 7 carbon atoms such as phenyl and m-hydroxyphenyl groups. The heterocyclic groups include 5-membered or 6-membered, saturated or unsaturated heterocyclic groups containing 1 to 5 carbon atoms, and at least one nitrogen or sulfur atom, wherein the number of the hetero atoms and variety of the elements constituting the ring may be either one or more. They are, for example, 2-furyl, 2-thienyl, 2-pyrimidinyl, imidazolyl and pyrazolyl groups.

The alkoxyl groups are those having 1 to 7 carbon atoms, preferably 1 to 5 carbon atoms, such as methoxy, ethoxy, 2-hydroxyethoxy and 2-methanesulfonylethoxy groups. The aryloxy groups are those having 6 or 7 carbon atoms, such as phenoxy and p-hydroxyphenoxy groups. The acylamino groups are those having 1 to 7 carbon atoms, preferably 1 to 5 carbon atoms, such as acetamido, 2-methoxypropionamido and p-hydroxybenzoylamido groups.

The alkylamino groups are those having 1 to 7 carbon atoms, preferably 1 to 4 carbon atoms, such as dimethylamino, diethylamino and 2-hydroxyethylamino groups. The anilino groups are those having 6 or 7 carbon atoms, such as anilino, m-nitroanilino and m-hydroxyanilino groups. The ureido groups are those having 1 to 7 carbon atoms, preferably 1 to 5 carbon atoms, such as ureido, methylureido, N,N-diethylureido and 2-methanesulfonamidoethylureido groups.

The sulfamoylamino groups are those having 0 to 7 carbon atoms, preferably 0 to 6 carbon atoms, such as dimethylsulfamoylamino, methylsulfamoylamino and 2-methoxyethylsulfamoylamino groups. The alkylthio groups are those having 1 to 7 carbon atoms, preferably 1 to 5 carbon atoms, such as methylthio, ethylthio and benzylthio groups. The arylthio groups are those having 6 or 7 carbon atoms, such as phenylthio, 2-carboxyphenylthio and 4-hydroxyphenylthio groups. The alkoxycarbonylamino groups are those having 2 to 7 carbon atoms, preferably 2 to 5 carbon atoms, such as methoxycarbonylamino, ethoxycarbonylamino and 3-methanesulfonylpropoxycarbonylamino groups.

The sulfonamido groups are those having 1 to 7 carbon atoms, preferably 1 to 6 carbon atoms, such as methanesulfonamido, p-toluenesulfonamido and 2-methoxyethanesulfonamido groups. The carbamoyl groups are those having 1 to 7 carbon atoms, preferably 1 to 5 carbon atoms, such as carbamoyl, N,N-dimethylcarbamoyl and N-ethylcarbamoyl groups. The sulfamoyl groups are those having 0 to 7 carbon atoms, preferably 0 to 5 carbon atoms, such as sulfamoyl, dimethylsulfamoyl and ethylsulfamoyl groups.

The sulfonyl groups are aliphatic or aromatic sulfonyl groups having 1 to 7, preferably 1 to 5 carbon atoms, such as methanesulfonyl, ethanesulfonyl and 2-chloroethanesulfonyl groups. The alkoxycarbonyl groups are those having 1 to 7, preferably 1 to 5 carbon atoms, such as methoxycarbonyl, ethoxycarbonyl and t-butoxycarbonyl groups. The heterocyclic oxy groups are 5-membered or 6-membered, saturated or unsaturated heterocyclic oxy groups containing 1 to 5 carbon atoms and at least one of oxygen, nitrogen and sulfur atoms, wherein the number of the hetero atoms and kind of the elements constituting the ring may be one or more, such as 1-phenyltetrazolyl-5-oxy, 2-tetrahydropyranyloxy and 2-pyridyloxy groups.

The azo groups are those having 1 to 7 carbon atoms, preferably 1 to 6 carbon atoms, such as phenylazo, 2-hydroxyphenylazo and 4-sulfophenylazo groups. The acyloxy groups are those having 1 to 7 carbon atoms, preferably 1 to 5 carbon atoms, such as acetoxy, benzoyloxy and 4-hydroxybutanoyloxy groups. The carbamoyloxy groups are those having 1 to 7 carbon atoms, preferably 1 to 5 carbon atoms, such as N,N-dimethylcarbamoyloxy, N-methylcarbamoyloxy and N-phenylcarbamoyloxy groups.

The silyl groups are those having 3 to 7 carbon atoms, preferably 3 to 5 carbon atoms, such as trimethylsilyl, isopropyldiethylsilyl and t-butyldimethylsilyl groups. The silyloxy groups are those having 3 to 7 carbon atoms, preferably 3 to 5 carbon atoms, such as trimethylsilyloxy and triethylsilyloxy groups. The aryloxycarbonylamino groups are those having 7 carbon atoms such as phenoxycarbonylamino and 4-cyanophenoxycarbonylamino groups.

The imido groups are those having 4 to 7 carbon atoms, such as N-succinimido group. The heterocyclic thio groups are 5-membered or 6-membered, saturated or unsaturated heterocyclic thio groups containing 1 to 5 carbon atoms and at least one of oxygen, nitrogen and sulfur atoms, wherein the number of the hetero atoms and kind of the elements constituting the ring may be one or more, such as 2-benzothiazolylthio and 2-pyridylthio groups.

The sulfinyl groups are those having 1 to 7 carbon atoms, preferably 1 to 6 carbon atoms, such as methanesulfinyl, benzenesulfinyl and ethanesulfinyl groups. The phosphonyl groups are those having 2 to 7 carbon atoms, preferably 2 to 5 carbon atoms, such as methoxyphosphonyl, ethoxyphosphonyl and phenoxyphosphonyl groups. The aryloxycarbonyl groups are those having 7 carbon atoms, such as phenoxycarbonyl and 3-hydroxyphenoxylcarbonyl groups. The acyl groups are those having 1 to 7 carbon atoms, preferably 1 to 6 carbon atoms, such as acetyl, benzoyl and 4-hydroxybenzoyl groups.

Preferred $R_1$ and $R_2$ are straight, branched or cyclic alkyl groups having 1 to 6 carbon atoms, which may be substituted with a substituent selected from among those mentioned above.

More preferred are alkyl groups substituted with a hydroxyl group, carboxyl group, sulfo group or sulfonamido group. The substituents may be any of primary, secondary and tertiary substituents, which may be further substituted with a substituent selected from among those mentioned above. These alkyl groups include, for example, 2-hydroxyethyl, 3-hydroxypropyl, 3-hydroxycyclopentyl, 2-hydroxypropyl, 4-hydroxybutyl, 5-hydroxypentyl, 2,3-dihydroxypropyl, 6-hydroxyhexyl, 4-hydroxypentyl, 3-hydroxybutyl, 4-hydroxy-4-methylpentyl, 5,6-dihydroxyhexyl, 4-hydroxycyclohexyl, 3,4-dihydroxybutyl, 3-hydroxy-2-(hydroxymethyl)propyl, 2,3,4-trihydroxybutyl, 4-(hydroxy-3-(hydroxymethyl)butyl, 2-hydroxy-2-methylpropyl, 2-carboxyethyl, 3-carboxypropyl, 4-carboxybutyl, 2-sulfoethyl, 3-sulfopropyl, 4-sulfobutyl, 2-methanesulfonamidoethyl, 3-methanesulfonamidopropyl and 4-methanesulfonamidobutyl groups.

$R_3$, $R_4$ and $R_5$ each represent a substituent. These substituents are the same as those described above with reference to $R_1$ and $R_2$.

$R_3$, $R_4$ and $R_5$ are each preferably a hydrogen atom, alkyl group having 1 to 6 carbon atoms, carboxyl group, acyl group having 1 to 6 carbon atoms or carbamoyl group, which may be further substituted with a substituent selected from among those mentioned above as a substituent of $R_1$ and $R_2$. More preferred $R_3$, $R_4$ and $R_5$ are hydrogen atom and the alkyl groups mentioned above as substituents of $R_1$ and $R_2$.

Among these, the following (1) or (2) is preferable since the compounds having the definition of $R_1$ to $R_5$ mentioned below are superior in terms of yellow image formation:

(1) $R_1$ and $R_2$ each is an unsubstituted straight or branched alkyl group having 1 to 6 carbon atoms or a straight or branched alkyl group having 1 to 6 carbon atoms substituted with a hydroxyl group, carboxyl group, sulfo group or sulfonamido group, $R_3$, $R_4$ and $R_5$ each is a hydrogen atom, an alkyl group (preferably having 1 to 6 carbon atoms) and at least one of $R_3$, $R_4$ and $R_5$ is substituted alkyl group. The substituent of the substituted alkyl group is preferably hydroxy, carboxy, sulfo, sulfonamido, acyl, carbamoyl, alcoxy and amino groups, more preferably hydroxy, carboxy, sulfo and sulfonamindo groups.

(2) $R_1$ and $R_2$ each is an unsubstituted straight or branched alkyl group having 1 to 6 carbon atoms or a straight or branched alkyl group having 1 to 6 carbon atoms substituted with a hydroxyl group, carboxyl group, sulfo group or sulfonamido group, $R_3$, $R_4$ and $R_5$ each is a hydrogen atom, an alkyl group (preferably having 1 to 6 carbon atoms), carboxy, acyl having 1 to 6 carbon atoms or carbamoyl group and at least one of $R_3$, $R_4$ and $R_5$ is a carboxy, acyl having 1 to 6 carbon atoms or carbamoyl group. In this connection, the alkyl group in $R_3$, $R_4$ and $R_5$ may be unsubstituted or have a substituent such as hydroxy, carboxy, sulfo and sulfonamido group.

Examples of preferred combinations of $R_3$, $R_4$ and $R_5$ include ($R_3$, $R_4$ and $R_5$ )=(methyl, methyl and hydrogen), (methyl, methyl and methyl), (methyl, hydroxymethyl and hydrogen), (methyl, ethyl and hydrogen), (methyl, methyl and hydroxymethyl), (methyl, hydroxyethyl and hydrogen), (methyl, carboxymethyl and hydrogen), (hydroxymethyl, hydroxymethyl and hydrogen), (methyl, benzyl and hydrogen), [methyl, bis(2-hydroxyethyl) aminomethyl and hydrogen], (methyl, 2-hydroxyethylcarbamoyl and hydrogen), (methyl, methoxymethyl and hydrogen), (methyl, methanesulfonamidomethyl and hydrogen), (methyl, acetyl and hydrogen), (methyl, carboxyl and methyl) and (methyl, phenyl and hydrogen).

Examples of preferred combinations of $R_1$ and $R_2$ to be combined with the combination of $R_3$, $R_4$ and $R_5$ are combinations of two groups selected from among methyl, ethyl, propyl, isopropyl, 2-hydroxyethyl, 3-hydroxypropyl, 2-hydroxypropyl, 4-hydroxybutyl, 5-hydroxypentyl, 2,3-dihydroxypropyl, 3,4-dihydroxybutyl, 3-hydroxy-2-(hydroxymethyl)propyl, 2,3,4-trihydroxybutyl, 4-(hydroxy-3-(hydroxymethyl)butyl and 2-hydroxy-2-methylpropyl groups, or alternatively, combinations of any of these groups with 2-carboxyethyl, 3-carboxypropyl, 4-carboxybutyl, 2-sulfoethyl, 3-sulfopropyl, 4-sulfobutyl, 2-methanesulfonamiodoethyl, 3-methanesulfonamidopropyl and 4-methanesulfonamidobutyl groups.

The compounds of the general formula (D) are, for example, those wherein $R_1$ and $R_2$ are each an alkyl group having 2 to 6 carbon atoms, and $R_3$, $R_4$ and $R_5$ each represent a hydrogen atom, alkyl group, carboxyl group, acyl group or carbamoyl group.

One or more of $R_1$, $R_2$, $R_3$, $R_4$ and $R_5$ are substituted with at least one hydroxyl group. When the number of the hydroxyl group is one, the number of the total carbon atoms in $R_1$ through $R_5$ is 4 to 6, preferably 4 to 5. When the number of the hydroxyl groups is 2, the number of the total carbon atoms in $R_1$ through $R_5$ is 4 to 9, preferably 4 to 8. When the number of the hydroxyl groups is 3 to 6 (preferably 3 to 5), the number of the total carbon atoms in $R_1$ through $R_5$ is 4 to 20. The total number of carbon atoms in $R_1$ through $R_5$ is limited in connection with the number of the hydrophilic hydroxyl groups in the present invention on the basis of the results of intensive investigations. Namely, it has been found that the hydrophobicity or hydrophilicity of the developing agents defined herein exerts a great influence on the photographic properties and that when the hydrophilicity of the developing agent is increased, good results which are beyond our expectations are obtained.

The developing agent having one hydroxyl group has the following advantages: it is suitable for the rapid processing, the deterioration of the developer with time is only slight, a high density of yellow and cyan colors can be obtained, the color balance is excellent, and the fastness to color change into brown by heat is excellent.

The developing agent having two hydroxyl groups has the following advantages: it is suitable for the rapid processing, the deterioration of the developer with time is only slight, a high density of yellow and cyan colors can be obtained, the color balance is excellent, and the staining after the development process is also only slight.

The developing agent having three hydroxyl groups has the following advantages: it is suitable for the rapid processing, the deterioration of the developer with time is only slight, a high density of yellow and cyan colors can be obtained, the color balance is excellent, and the fastness of yellow to light is excellent.

Examples of the typical developing agents of the general formula (D) in the present invention will be given below, which by no means limit the invention:

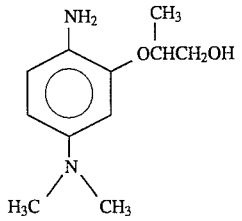

(D-1)

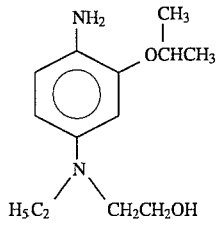

(D-2)

-continued
(D-3)
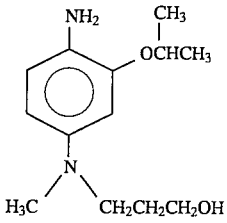
(D-4)
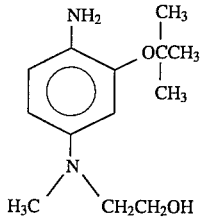
(D-5)
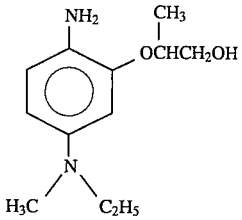
(D-6)
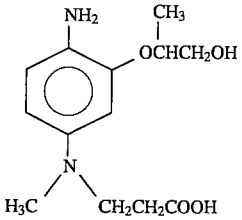
(D-7)
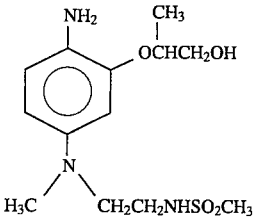
(D-8)
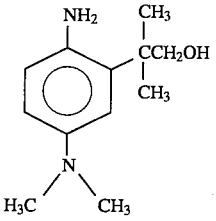
(D-9)
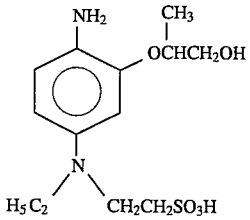
-continued
(D-10)
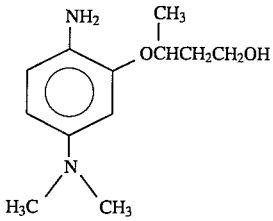
(D-11)
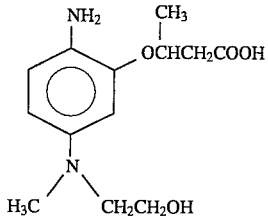
(D-12)
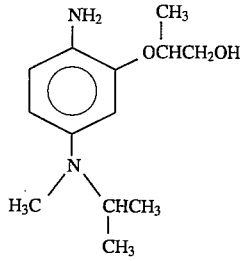
(D-13)
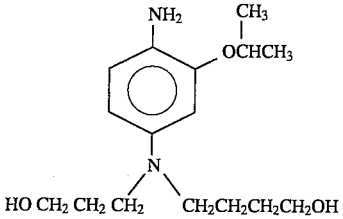
(D-14)
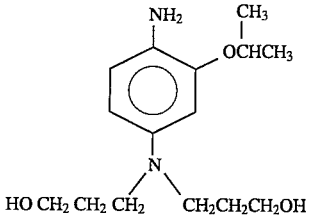
(D-15)
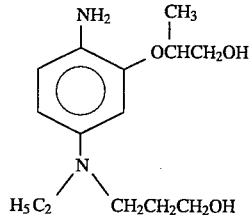
(D-16)
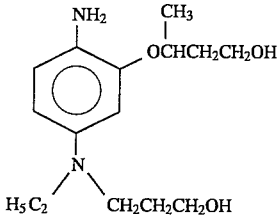

-continued
(D-17)
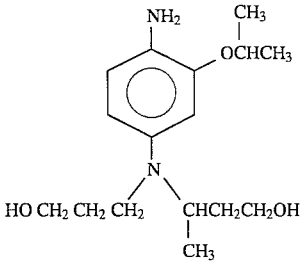
(D-18)
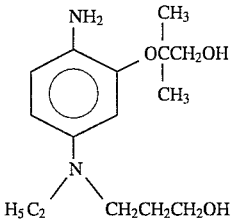
(D-19)
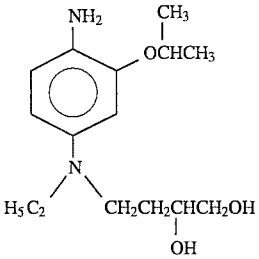
(D-20)
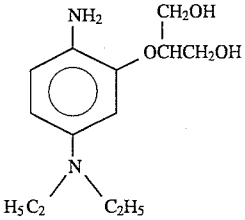
(D-21)
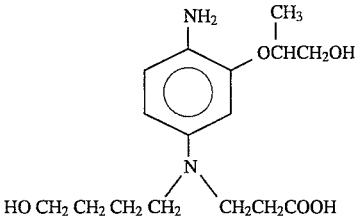
(D-22)
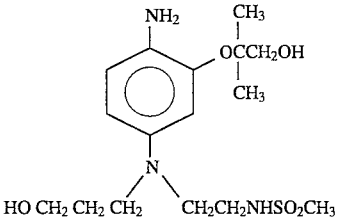
(D-23)
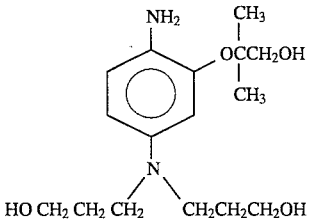
-continued
(D-24)
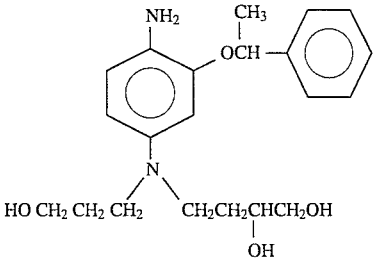
(D-25)
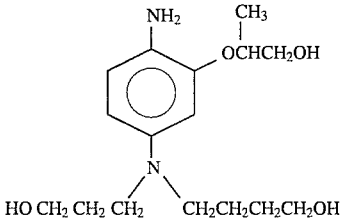
(D-26)
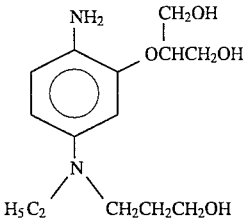
(D-27)
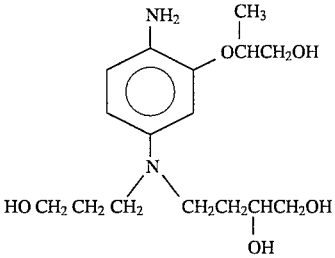
(D-28)
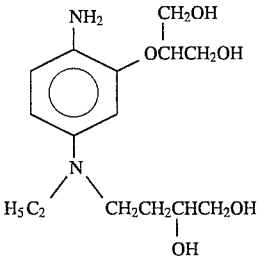
(D-29)
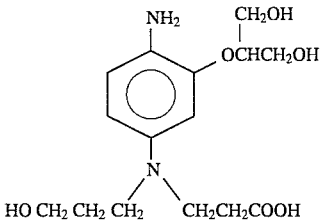

-continued (D-30)

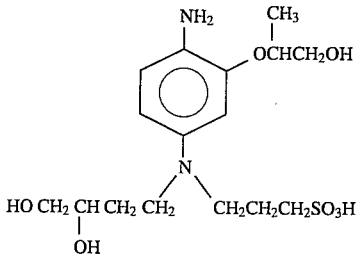

(D-31)

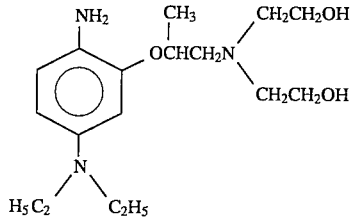

(D-32)

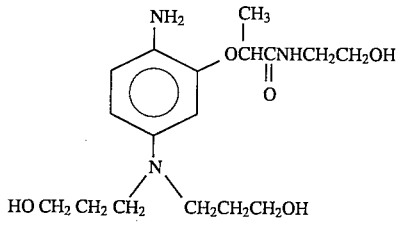

(D-33)

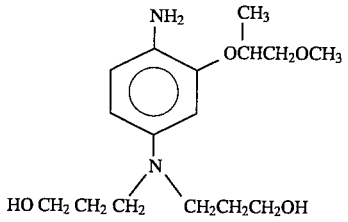

(D-34)

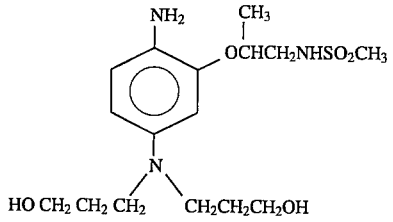

(D-35)

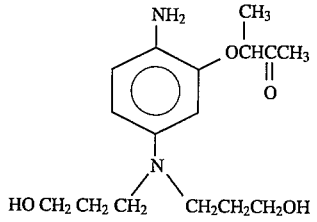

(D-36)

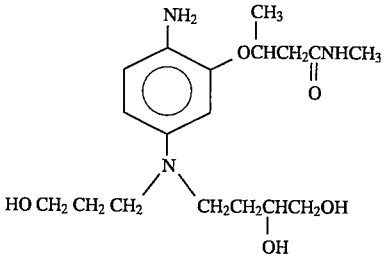

-continued (D-37)

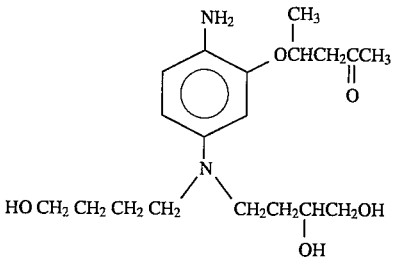

(D-38)

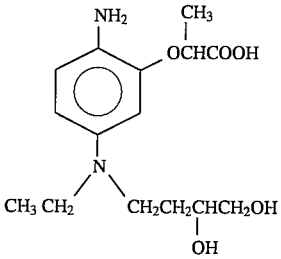

(D-39)

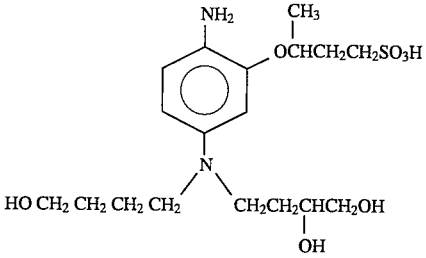

Since the compounds of the general formula (D) are very unstable when they are stored in the form of the free amines, they are usually produced and stored in the form of salts with an inorganic or organic acid and converted into the free amines when they are to be added to the processing solution. The inorganic and organic acids used for forming the salts with the compounds of the general formula (D) include, for example, hydrochloric acid, sulfuric acid, phosphoric acid, p-toluenesulfonic acid, methanesulfonic acid and naphthalene-1,5-disulfonic acid. Among these salts, preferred are sulfates and p-toluenesulfonates. The most preferred is sulfates.

The color developing agent of the present invention can be easily synthesized by methods of the following synthesis examples and methods similar to them. Known synthesizing methods such as those described in Journal of American Chemical Society, Vol. 73, pages 3100 to 3125 (1951) can also be employed for the synthesis.

Synthesis Example 1

A compound (D-14) of the present invention given above was synthesized according to the following formula:

Synthesis of (D-14)

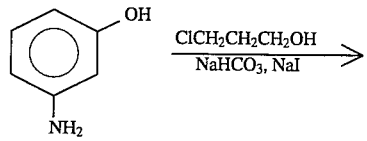

(14-a)

-continued

Synthesis of (D-14)

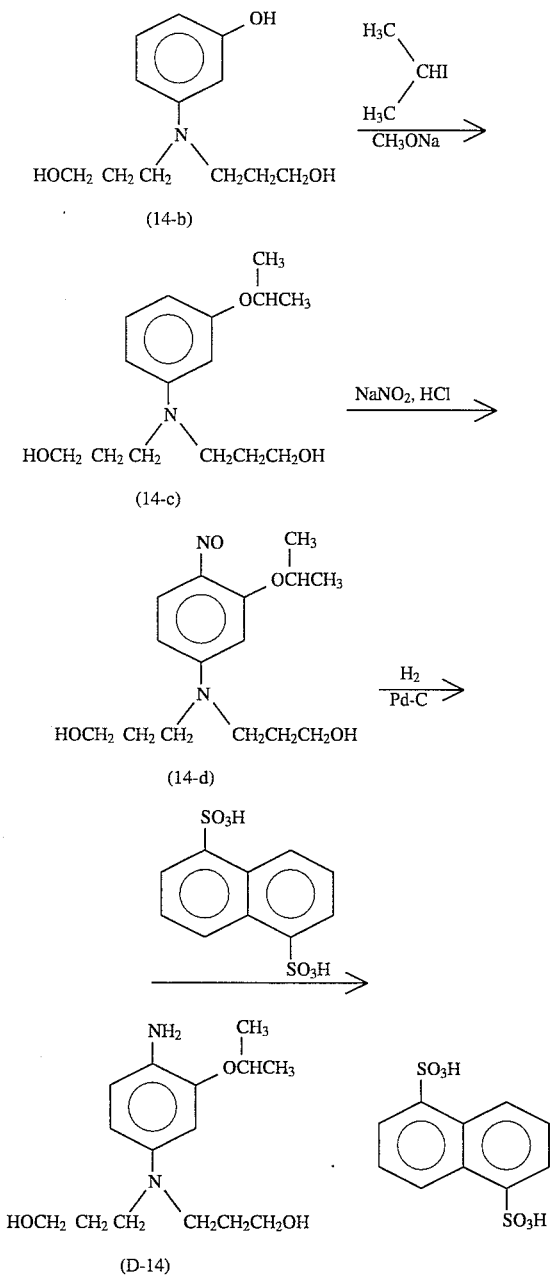

Synthesis of (14-b):

109 g of m-aminophenol, 176 g of sodium hydrogencarbonate and 60 g of sodium iodide were added to 350 ml of dimethylacetamide, and the resultant mixture was stirred under heating at 130° C. , to which 199 g of 3-chloropropanol was slowly added. After stirring under heating at 130° C. for additional 6 hours, the temperature was lowered to room temperature. The obtained mixture was poured into water. After extraction with chloroform, the solvents (chloroform and dimethylacetamide) were distilled off under reduced pressure. Ethyl acetate was added to the residue and the resultant mixture was stirred to form crystals, which were purified by recrystallization to obtain 84 g (yield: 37%) of (14-b).

Synthesis of (14-c):

84 g of (14-b) and 76 g of 28% solution of sodium methoxide in methanol were added to 200 ml of dimethylacetamide, and the resultant mixture was heated under stirring to finally 120° C. while methanol was distilled off. 95 g of isopropyl iodide was slowly added to the residue, and the resultant mixture was further heated at 120° C. under stirring for 5 hours. The reaction system was cooled to room temperature and then poured into water. After extraction with ethyl acetate followed by washing with saturated aqueous common salt solution and drying over Glauber's salt, the product was concentrated. After purification by silica gel column chromatography, 69 g (yield: 56%) of (14-c) was obtained.

Synthesis of (14-d):

69 g of (14-c) and 47 ml of concentrated hydrochloric acid were added to 300 ml of water. 70 ml of an aqueous solution of 17 g of sodium nitrite was slowly added to the resultant mixture under stirring and under cooling with ice. After stirring for 4 hours, 26 g of sodium hydrogencarbonate was added to the mixture, from which inorganic substances were removed by filtration through Celite. Methanol and ethyl acetate were added to the filtrate, and the resultant mixture was concentrated to obtain an oil, which was purified by silica gel column chromatography to obtain 52 g (yield: 68%) of (14-d).

Synthesis of (D-14) exemplified above:

52 g of (14-d) and 1 g of 10% palladium-carbon were added to 500 ml of methanol, and they were contacted with hydrogen in an autoclave for 2 hours. Then the catalyst was filtered off by using Celite as a filter aid, and then the filtrate was dropped into a solution of 63 g of 1,5-naphthalenedisulfonic acid tetrahydrate in methanol. The crystals thus precipitated were taken by filtration to obtain 91 g of 1,5-naphthalenedisulfonate of the intended compound (D-14) in the form of white crystals. (yield: 91%). Melting point: 149 to 152° C.

Synthesis Example 2

1,5-Naphthalenedisulfonate of the above-exemplified intended compound (D-2) of the present invention was obtained in the form of white crystals in the same manner as in Synthesis Example 1. Melting point: 252° to 254° C.

Synthesis Example 3

1,5-Naphthalenedisulfonate of the above-exemplified intended compound (D-20) of the present invention was obtained in the form of white crystals in the same manner as in Synthesis Example 1. Melting point: 227° to 230° C.

Synthesis Example 4

1,5-Naphthalenedisulfonate of the above-exemplified intended compound (D-23) of the present invention was obtained in the form of white crystals in the same manner as in Synthesis Example 1. Melting point: 204° to 207° C.

The color developing agent of the present invention can be used either singly or in combination with other known p-phenylenediamine derivatives. Typical examples of the compounds which can be used in combination with the color developing agent include the following compounds, which by no means limit them: N,N-diethyl-p-phenylenediamine (P-1), 4-amino-3-methyl-N,N-diethylaniline (P-2), 4-amino-3-methyl-N-ethyl-N-(3-hydroxypropyl)aniline (P-3), 4-amino-N-ethyl-N-(2-hydroxyethyl)aniline (P-4), 4-amino-3-methyl-N-ethyl-N-(2-hydroxyethyl)aniline (P-5), 4-amino-3-methyl-N-ethyl-N-(2-methanesulfonamidoethyl)aniline (P-6), N-(2-amino-5-N,N-diethylaminophenylethyl)methane sulfonamide (P-7), N,N-dimethyl-p-phenylenediamine (P-8), 4-amino-3-methyl-N-ethyl-N-(2-methoxyethyl) aniline (P-9), 4-amino-3-methyl-N-ethyl-N-(4-hydroxybutyl)aniline (P-10), and 4-amino-3-methyl-N-ethyl-N-(2-butoxyethyl)aniline (P-11). Among the above-described p-phenylenediamine derivatives to be used for the combination, particularly preferred are compounds P-3, P-5, P-6 and P-10. The p-phenylenediamine derivatives are usually used in the form of their salts such as sulfates, hydrochlorides, sulfites, p-toluenesulfonates, nitrates and naphthalene-1,5-disulfonates.

The processing composition may be in liquid form or solid form (such as powdery or granular form).

These compounds can be used in combination of two or more of them depending on the purpose. The aromatic primary amine developing agent is used in an amount of preferably about 0.001 to 0.2 mol, more preferably 0.005 to 0.1 mol, per liter of the color developer.

The color developer may contain a compound for directly preserving the above-described aromatic primary amine color developing agent, which is selected from among hydroxylamines described in J. P. KOKAI Nos. Sho 63-5341, Sho 63-106655 and Hei 4-144446, hydroxamic acids described in J. P. KOKAI No. Sho 63-43138, hydrazines and hydrazides described in J. P. KOKAI No. Sho 63-146041, phenols described in J. P. KOKAI Nos. Sho 63-44657 and Sho 63-58443, α-hydroxyketones and α-aminoketones described in J. P. KOKAI No. Sho 63-44656, and saccharides described in J. P. KOKAI No. Sho 63-36244. Such a compound can be used in combination with monoamines described in J. P. KOKAI Nos. Sho 63-4235, 63-24254, 63-21647, 63-146040, 63-27841 and 63-25654, diamines described in J. P. KOKAI Nos. Sho 63-30845, 63-14640 and 63-43139, polyamines described in J. P. KOKAI Nos. Sho 63-21647, 63-26655 and 63-44655, nitroxy radicals described in J. P. KOKAI No. Sho 63-53551, alcohols described in J. P. KOKAI Nos. Sho 63-43140 and 63-53549, oximes described in J. P. KOKAI No. Sho 63-56654 and tertiary amines described in J. P. KOKAI No. Sho 63-239447. The color developer may contain, if necessary, also a preservative such as metals described in J. P. KOKAI Nos. Sho 57-44148 and 57-53749, salicylic acids described in J. P. KOKAI No. Sho 59-180588, alkanolamines described in J. P. KOKAI No. Sho 54-3582, polyethyleneimines described in J. P. KOKAI No. Sho 56-94349 and aromatic polyhydroxy compounds described in U.S. Pat. No. 3,746,544. Particularly when the hydroxylamines are used, they are preferably used in combination with the above-described alkanolamines or aromatic polyhydroxy compounds.

Particularly preferred preservatives are hydroxylamines represented by general formula (I) given in J. P. KOKAI No. Hei 3-144446. Among them, compounds having methyl, ethyl, sulfo or carboxyl group are preferred. The preservative is used in an amount of 20 to 200 mmol, preferably 30 to 150 mmol, per liter of the color developer.

The color developer for the photosensitive material for prints contains preferably $3.0\times10^{-2}$ to $1.5\times10^{-1}$ mol/l , particularly preferably $3.5\times10^{-2}$ to $1.0\times10^{-1}$ mol/l , of chlorine ion. When the chlorine ion concentration is higher than $1.5\times10^{-1}$ mol/l or particularly higher than $1.0\times10^{-1}$ mol/l , the development is retarded, which is against the object of the present invention, i.e. to rapidly attain the high maximum density and, on the contrary, a chlorine ion concentration of below $3.0\times10^{-2}$ is unsuitable for prevention of the fogging.

The color developer used in the present invention contains preferably $0.5\times10^{-5}$ to $1.0\times10^{-3}$ mol/l , more particularly $3.0\times10^{-5}$ to $5\times10^{-4}$, mol/l of bromine ion. When the bromine ion concentration is higher than $1.0\times10^{-3}$ mol/l , the development is retarded, and the maximum density and sensitivity are lowered and, on the contrary, when it is below $0.5\times10^{-5}$ mol/l , the fogging cannot be sufficiently prevented.

The chlorine ion and bromine ion can be directly added to the color developer or they can be dissolved out of the photosensitive material into the color developer in the course of the development.

When the chlorine ion is directly added to the color developer, the chlorine ion-feeding substances include sodium chloride, potassium chloride, ammonium chloride, lithium chloride, magnesium chloride and calcium chloride. The chlorine ion can be fed from a fluorescent brightener added to the color developer. The bromine ion-feeding substances include sodium bromide, potassium bromide, ammonium bromide, lithium bromide, calcium bromide and magnesium bromide.

When the chlorine ion or bromine ion is dissolved out of the photosensitive material in the course of the development, such an ion can be fed by an emulsion or another substance.

The color developer of the present invention may further contain additives mentioned in the above-described J. P. KOKAI No. Hei 3-144446. For example, a compound selected from among carbonates, phosphates, borates and hydroxybenzoates mentioned on page 9 of the specification thereof can be used as a buffering agent for maintaining pH. pH of the color developer is kept preferably in the range of 9.0 to 12.5, more preferably in the range of 9.5 to 11.5 with such a buffering agent.

Antifoggants usable herein are halide ions and organic antifoggants mentioned on page 10 of that specification. Particularly when the concentration of the color developing agent in the color developer is as high as 20 mmol/l or above or when the processing temperature is as high as 40° C. or above, a considerably high bromide ion concentration is preferred. Namely, it is preferably 17 to 60 mmol/l . If necessary, the concentration can be controlled in a preferred range by removing the halogen with an ion exchange resin or ion exchange membrane.

The chelating agents preferably used herein are aminopolycarboxylic acids, aminopolyphosphonic acids, alkylphosphonic acids and phosphonocarboxylic acids. They are typified by ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of them. Preferred chelating agents are biodegradable compounds such as those mentioned in J. P. KOKAI Nos. Sho 63-146998, 63-199295, 63-267750 and 63-267751 and Hei 2-229146 and 3-186841, German Patent No. 3739610 and European Patent No. 468325.

The color developer of the present invention may contain, if necessary, also a development restrainer such as a benzimidazole, benzothiazole or mercapto compound; a development accelerator such as a benzyl alcohol, polyethylene glycol, quaternary ammonium salt or amine; a dye-forming coupler; a competitive coupler; an assistant developing agent such as 1-phenyl-3-pyrazolidone; a tackifier; and a surfactant such as an alkylsulfonic acid, arylsulfonic acid, aliphatic carboxylic acid or aromatic carboxylic acid.

If necessary, a development accelerator can be added to the color developer.

The development accelerators include thioether compounds described in Japanese Patent Publication for Opposition Purpose (hereinafter referred to as "J. P. KOKOKU") Nos. Sho 37-16088, 37-5987, 38-7826, 44-12380 and 45-9019 and U.S. Pat. No. 3,813,247; p-phenylenediamine compounds described n J. P. KOKAI Nos. Sho 52-49829 and 50-15554; quaternary ammonium salts described in J. P. KOKAI No. Sho 50-137726, J. P. KOKOKU No. Sho 44-30074 and J. P. KOKAI Nos. Sho 56-156826 and 52-43429; amine compounds described in U.S. Pat. Nos. 2,494,903, 3,128,182, 4,230,796 and 3,253,919, J. P. KOKOKU No. Sho 41-11431 and U. S. Pat. Nos. 2,482,546, 2,596,926 and 3,582,346; polyalkylene oxides described in J. P. KOKOKU Nos. Sho 37-16088 and 42-25201, U.S. Pat. No. 3,128,183, J. P. KOKOKU Nos. Sho 41-11431 and 42-23883 and U. S. Pat. No. 3,532,501; as well as 1-phenyl-3-pyrazolidones and imidazoles. These development accelerators are usable, if necessary.

When the color developer is used for processing a photosensitive material for photography, the replenisher is fed in an amount of preferably 550 ml or below, more preferably 450 ml of below, most preferably 80 to 400 ml, per $m^2$. By reducing bromide ion concentration in the replenisher or by using no bromide ion, the amount thereof can be reduced to 300 ml or below. In processing a photosensitive material for prints, the color developer replenisher is fed in an amount of 20 to 600 ml, preferably 30 to 200 ml and more preferably 40 to 100 ml, per $m^2$ of the material.

In processing the photosensitive material for photography, the processing temperature with the color developer is preferably 35° C. or above, more preferably 40° to 50° C. In processing the photosensitive material for prints, the processing temperature with the color developer is preferably is 20° to 50° C., preferably 30° to 45° C., and most preferably 37° to 42° C.

In processing the photosensitive material for photography, the processing time with the color developer is preferably 30 seconds to 3 minutes and 15 seconds, more preferably 30 seconds to 2 minutes and 30 seconds. In processing the photosensitive material for printing, the processing time with the color developer is usually shorter than 3 minutes, preferably 10 seconds to 1 minute and more preferably 10 to 30 seconds. The term "processing time" (such as development time) herein indicates the time necessitated from entering of the photosensitive material into a processing bath to entering of it into the next processing bath.

It is preferred that the developer for the photosensitive material for printing is substantially free from benzyl alcohol.

To control the change of the photographic characteristics during the continuous process and also to attain the effect of the present invention, it is also preferred that the developer for the photosensitive material for printing is substantially free from sulfurous acid ion (the term "substantially free" herein indicates that sulfurous acid ion concentration is not higher than $3.0\times10^{-3}$ mol/l). Sulfurous acid ion concentration is preferably not higher than $1.0\times10^{-3}$ mol/l, and most preferably, the developer is free from sulfurous acid ion. It is to be noted, however, a very small amount of sulfurous acid ion used, before the preparation of the developer, for inhibiting the oxidation of the processing agent kit containing a concentrated developing agent is not included therein. To control the change of the photographic characteristics depending on the change in concentration of a hydroxylamine, it is more preferred that the developer is substantially free from the hydroxylamine (the term "substantially free" herein indicates that the hydroxylamine concentration is not higher than $5.0\times10^{-3}$ mol/l). It is most preferred that the developer is completely free from the hydroxylamine.

It is preferred to inhibit the evaporation of the developer and oxidation thereof by air. The contact area of the processing liquid with air in the processing vessel can be represented by the opening rate defined as follows:

Opening rate=[(contact area of processing solution with air ($cm^2$)]/[volume of processing solution ($cm^3$)]

The opening rate ($cm^{-1}$) defined as above is preferably not higher than 0.05, more preferably in the range of 0.0005 to 0.01. The opening rate is reduced by covering the surface of the photographic processing solution in the processing vessel with a floating lid or the like, by providing a movable lid as described in J. P. KOKAI No. Hei 1-82033 or by a slit development process described in J. P. KOKAI No. Sho 63-216050. It is preferred that the processing solution in a color developer-replenishing tank or in a processing tank is sealed with a high-boiling organic solvent or a high-molecular compound to reduce the contact area thereof with air. It is particularly preferred to use liquid paraffin, an organosiloxane or the like. The opening rate can be reduced not only in the color development and black-and-white development steps but also in all of the subsequent steps such as bleaching, bleach-fixing, fixing, water washing and stabilization steps.

The developer can be reused by regeneration. The term "regeneration of the developer" herein indicates that the used developer is treated with an anion exchange resin or by electrodialysis and that the activity of the developer is increased by adding a processing agent called "regenerating agent". The regeneration rate (rate of the overflow in the replenisher) is preferably at least 70%, particularly at least 90%.

The regeneration is conducted preferably with the anion exchange resin. Particularly preferred composition of the anion exchange resin and method for regeneration of the resin are those described in "Diaion Manual" (Edition 14, 1986) published by Mitsubishi Chemical Industries Ltd. Among the anion exchange resins, preferred are those of a composition described in J. P. KOKAI Nos. Hei 2-952 and 1-281152.

The color-developed photosensitive material is then desilvered. The desilverization process herein basically comprises bleaching process and fixing process. Both processes can be conducted at the same time by a bleach-fixing process or these processes are combined with each other.

The bleaching agents include, for example, iron salts; compounds of polyvalent metals such as iron (III), cobalt (III), chromium (IV) and copper (II); peracids; quinones; and nitro compounds. Typical bleaching agents are, for example, ferric oxide, ferricyanides, bichromates; organic complex salts of iron (III) (such as metal complex salts of aminopolycarboxylic acids, e.g. ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid); persulfates; bromates; permanganates; and nitrobenzenes. Among them, preferred are ferric aminopolycarboxylates and salts of them as described on page 11 of the above-mentioned J. P. KOKAI No. Hei 3-144446. Examples of them include ferric salts of ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid. Other bleaching agents include complex salts of citric acid, tartaric acid and malic acid. Among them, particularly preferred are iron (III) complex salt of ethylenediaminetetraacetic acid and iron (III) complex salts of aminopolycarboxylic acids such as iron (III) complex salt of 1,3-diaminopropanetetraacetic acid. Such an iron (III) complex salt of aminopolycarboxylic acid is particularly effective in both bleaching solution and bleach-fixing solution.

The bleaching solution, bleach-fixing solution, pre-bleaching bath and pre-bleach-fixing bath may contain a bleaching accelerator, if necessary. Examples of the bleaching accelerators include compounds having a mercapto group or disulfido bond described in U.S. Pat. No. 3,893,858, West German Patent No. 1,290,812, J. P. KOKAI No. Sho 53-95630 and Research Disclosure No. 17129 (July, 1978); thiazolidine derivatives described in J. P. KOKAI No. Sho 50-140129; thiourea derivatives described in U.S. Pat. No. 3,706,561; iodides described in J. P. KOKAI No. Sho 58-16235; polyoxyethylene compounds described in West German Patent No. 2,748,430; polyamine compounds described in J. P. KOKOKU No. Sho 45-8836; and bromide ions. Among them, compounds having a mercapto group or disulfido group and having a remarkable accelerating effect are preferred. Particularly preferred are compounds described in U. S. Pat. No. 3,893,858, West German Patent No. 1,290,812 and J. P. KOKAI No. Sho 53-95630. Further, compounds described in U.S. Pat. No. 4,552, 834 are also preferred. These bleach-accelerators may be added also to the photosensitive material. When a color photosensitive material for photography is to be bleach-fixed, these bleaching accelerators are particularly effective.

The desilvering bath may contain rehalogenating agents, pH buffering agents and other known additives as described on page 12 of J. P. KOKAI No. Hei 3-144446, in addition to the bleaching agent.

An organic acid is preferably incorporated into the bleaching solution and bleach-fixing solution in order to prevent a bleach stain, in addition to the above-described compounds. Particularly preferred organic acids are those having an acid dissotiation constant (pKa) of 2 to 6 such as acetic acid, propionic acid, hydroxyacetic acid, succinic acid, maleic acid, glutaric acid, fumaric acid, malonic acid and adipic acid. Particularly preferred are succinic, maleic and glutaric acids.

The pH of the bleaching solution and bleach-fixing solution is usually 4.0 to 8.0. For conducting the process more rapidly, the pH can be further lowered.

The fixing agents usable for the fixing solution or bleach-fixing solution include, for example, thiosulfates, thiocyanates, thioether compounds, thioureas and a large amount of iodides. Among them, the thiosulfates are commonly used and ammonium thiosulfate is most widely usable. A combination of a thiosulfate with a thiocyanate, thioether compound or thiourea is also preferred.

Examples of preferred preservatives for the fixing solution and bleach-fixing solution include sulfites, hydrogensulfites, carbonylhydrogensulfite adducts and sulfinic acid compounds described in European Patent No. 294769 A. Further, it is preferred to add a chelating agent such as an aminopolycarboxylic acid or organic phosphonic acid to the fixing solution or bleach-fixing solution in order to stabilize it. Examples of preferred chelating agents include 1-hydroxyethylidene-1,1-diphosphonic acid, ethylenediamine-N,N,N,N'-tetrakis(methylenephosphonic acid), nitrilotrimethylenephosphonic acid, ethylenediaminetetraacetic acid, diethylenetriaminepentaacetic acid, cyclohexanediaminetetraacetic acid and 1,2-propylenediaminetetraacetic acid. Among them, 1-hydroxyethylidene-1,1-diphosphonic acid and ethylenediaminetetraacetic acid are particularly preferred.

It is preferred to incorporate a compound having a pKa of 6.0 to 9.0 such as imidazole, 1-methylimidazole, 1-ethylimidazole or 2-methylimidazole into the fixing solution or bleach-fixing solution in order to adjust pH thereof.

The imidazole compounds herein indicate imidazole and derivatives thereof. Preferred substituents of imidazole include, for example, alkyl, alkenyl, alkynyl, amino and nitro groups and halogen atoms. The alkyl, alkenyl and alkynyl groups may be further substituted with an amino or nitro group or a halogen atom. The total carbon number of the substituents of imidazole is preferably 1 to 6. The most preferred substituent is methyl group.

Examples of the imidazole compounds will be given below, which by no means limit them: imidazole, 1-methylimidazole, 2-methylimidazole, 4-methylimidazole, 4-(2-hydroxyethyl)-imidazole, 2-ethylimidazole, 2-vinylimidazole, 4-propylimidazole, 4-(2-aminoethyl) imidazole, 2,4-dimethylimidazole, and 2-chloroimidazole. Among them, preferred are imidazole, 2-methylimidazole and 4-methylimidazole. The most preferred is imidazole.

The fixing solution and bleach-fixing solution may further contain a fluorescent brightening agent; defoaming agent; surfactant; polyvinylpyrrolidone; methanol; etc.

When a replenishing system is employed, the quantity of the fixing solution or bleach-fixing solution to be used as the replenisher is preferably 100 to 3,000 ml, more preferably 300 to 1800 ml, per $m^2$ of the photosensitive material. The bleach-fixing solution as the replenisher can be fed as a bleach-fixing replenisher or, as described in J. P. KOKAI No. Sho 61-143755 or Japanese Patent Application No. Hei 2-216389, overflowing bleaching solution and fixing solution can be used.

The total processing time in the desilvering step comprising bleaching, bleach-fixing and fixing of the photosensitive material for photography is preferably 30 seconds to 3 minutes, more preferably 45 seconds to 2 minutes. The processing temperature is 30° to 60° C., preferably 35° to 55° C.

In processing with a processing solution having a bleaching effect, it is particularly preferred to conduct aeration so as to keep the photographic properties very stable. The aeration can be conducted by a method known in the art, such as blowing of air into the solution having the bleaching effect or absorption of air with an ejector.

In the blowing of air, it is preferred to release air into the solution by means of a diffusing tube having fine pores. Such a type of diffusing tube is widely used for an aeration tank in the treatment of an activated sludge. In the aeration, techniques described on pages BL-1 to BL-2 of Z-121, Using Process C-41 (the third edition) published by Eastman Kodak Co. in 1982 can be employed. In the process of the present invention with the processing solution having bleaching effect, vigorous stirring is preferred. For the stirring, contents of J. P. KOKAI No. Hei 3-33847 (from line 6, right upper column to line 2, left lower column on page 8) can be employed as they are.

Silver can be recovered from the processing solution having the fixing effect by a well-known method, and the regenerated solution is usable. Silver can be recovered by an electrolysis method (French Patent No. 2,299,667), precipitation method (J. P. KOKAI No. Sho 52-73037 and German Patent No. 2,331,220), ion exchange method (J. P. KOKAI No. Sho 51-17114 and German Patent No. 2,548,237) and metal replacement method (British Patent No. 1,353,805). In these methods, silver is preferably recovered in line from the tank solution so as to improve the rapidness.

The processing solution having the bleaching effect is reusable by recovering the overflow used in the process and adding the components to regulate the composition thereof. Such a regeneration is easy in the present invention. The details of the regeneration are described on pages 39 to 40 of Fuji Film Processing Manual, Fuji Color Negative Film, CN-16 Process (revised in August, 1990) published by Fuji Photo Film Co., Ltd.

Although the kit for preparing the processing solution of the present invention having the bleaching effect may be in the form of either liquid or powder, the powder is more easily prepared than the liquid, since most starting materials are in powder form having only a slight hygroscopicity after removal of ammonium salts.

Further, the kit for the regeneration is preferably in the form of a powder from the viewpoint of reduction in the quantity of waste water, since it can be directly added without using excess water.

For the regeneration of the processing solution having the bleaching function, a method described in "Shashin Kogaku no Kiso,—Gin'en Shashin Hen—(The Fundamentals of Photographic Engineering,—Edition of Silver Salt Photographs-)" (edited by Nihon Shashin Gakkai and published by Corona in 1979) can be employed in addition to the above-described aeration method. In particular, the bleaching solution can be regenerated by an electrolytic regeneration method or a method wherein hydrobromic acid, chlorous acid, bromine, a bromine precursor, a persulfate, and hydrogen peroxide, or a combination of a catalyst with hydrogen peroxide, bromous acid or ozone is used.

In the electrolytic regeneration method, a cathode and an anode are placed in the same bleaching bath, or the anodic bath is separated from the cathodic bath with a diaphragm. In another electrolytic regeneration method, the bleaching solution and developer and/or fixing solution can be regenerated at the same time by using a diaphragm.

The fixing solution and bleach-fixing solution are regenerated by electrolytically reducing silver ion accumulated therein. To maintain the fixing function, it is also preferred to remove the accumulated halogen ion with an anion exchange resin.

In the desilverizing steps, the stirring is conducted preferably as vigorously as possible by, for example, a method which comprises bumping a jet of the processing solution against the emulsion surface of the photosensitive material as described in J. P. KOKAI No. Sho 62-183460; a method wherein the stirring effect is improved with a rotating means as described in J. P. KOKAI No. Sho 62-183461; a method wherein the photosensitive material is moved while the emulsion surface thereof is brought into contact with a wiper blade provided in the solution so as to make the flow on the emulsion surface turbulent and thereby improving the effect of the stirring; and a method wherein the quantity of the circulating flow of the whole processing solutions is increased. Such a means of making the stirring vigorous is effective for any of the bleaching solution, bleach-fixing solution and fixing solution. Supposedly, the improvement in the stirring effect accelerates the feeding of the bleaching agent and fixing agent into the emulsion membrane, thereby increasing the desilverizing speed. The above-described means of improving the stirring effect are more effective when a bleaching accelerator is used. In such a case, the acceleration effect is further improved and inhibition of the fixing by the bleaching accelerator can be controlled.

An automatic developing machine used for developing the photosensitive material of the present invention preferably has a means of transporting the photosensitive material as described in J. P. KOKAI Nos. Sho 60-191257, 60-191258 and 60-191259. As described in J. P. KOKAI No. Sho 60-191257, such a transportation means remarkably reduces the amount of the processing solution brought from the preceding bath into the subsequent bath, so that the deterioration in the function of the processing solution can be remarkably prevented. Such a function is particularly effective in reducing the processing time in each step and also in reducing the amount of the replenisher.

After the desilverization process, the photosensitive material is usually washed with water. The step of washing with water may be replaced with a stabilization step. In the stabilization process, any of known methods described in J. P. KOKAI Nos. Sho 57-8543, 58-14834 and 60-220345 can be employed. Further, step of washing with water/stabilization step wherein a stabilization bath containing both dye stabilizer and a surfactant is used as the final bath can be employed.

Water used for washing and the stabilizing solution can contain a softening agent for hard water, such as an inorganic phosphoric acid, polyaminocarboxylic acid or organic aminophosphonic acid.

The amount of water used in the washing step or the like varies in a wide range depending on the properties of the photosensitive material (which depend on, for example, couplers used), use thereof, temperature of water, number of the tanks (number of stages), replenishing method such as counter flow or down-flow system and various other conditions. Two to four stages are preferred. The amount of the replenisher is 1 to 50 times, preferably 1 to 30 times and more preferably 1 to 10 times larger than that brought from the preceding bath per a unit area. A preferred method for efficiently reducing the amount of the replenisher is so-called multi-tank washing method or stabilizing method wherein the water washing tank or stabilizing tank is divided with a diaphragm so that the photosensitive material is processed in the liquid by passing it through a slit of a wiper blade or the like without being exposed to air.

Although the amount of water necessitated for washing can be remarkably reduced by the multi-stage counter flow method or multi-tank washing method, another problem is caused in this method that bacteria propagate themselves while water is kept for a longer time in the tanks and, as a result, a suspended matter thus formed is attached to the photosensitive material. For solving this problem, a very effective method for previously reducing the amount of calcium ion and magnesium ion described in J. P. KOKAI No. Sho 62-288,838 can be employed. Further, this problem can be solved also by using water previously sterilized with a germicide such as chlorinated sodium isocyanurates. Further, the water used for washing can contain isothiazolone compounds and thiabendazole described in J. P. KOKAI No. Sho 57-8,542, known chlorine-containing germicides and benzotriazoles described in Hiroshi Horiguchi "Bokin Bobai-zai no Kagaku (Chemistry for Prevention of Bacteria and Fungi)" published by Sankyo Book Publishing Co. in 1986, "Biseibutsu no Mekkin, Sakkin, Bobai Gijutsu (Technique of Sterilization and Prevention of Microorganisms)" edited by Eisei Gijutsu-kai and published by Kogyo Gijutsu-kai in 1982 and "Bokinbobai-zai Jiten (Dictionary of Steriliers and Antifungal Agents)" edited by Nippon Bokinbobai Gakkai and published in 1986.

The pH of washing water and the stabilizing solution is 4 to 9, preferably 5 to 8. The temperature and time which vary depending on the properties and use of the photosensitive material are usually 15° to 45° C. and 10 seconds to 10 minutes, preferably 25° to 40° C. and 15 seconds to 5 minutes. The photosensitive material can be processed directly with a stabilizing solution in place of washing with water. The stabilization can be conducted by any of known processes described in J. P. KOKAI Nos. Sho 57- 8543, 58-14834 and 60-220345.

The stabilizing solution contains a compound which stabilizes the color image, selected from among, for example, formalin, benzaldehydes such as m-hydroxybenzaldehyde, formaldehyde/bisulfite adduct, hexamethylenetetramine and derivatives thereof, hexahydrotriazine and derivatives thereof, dimethylolurea, N-methylol compounds such as N-methylolpyrazole, organic acids and pH buffering agents. The preferred amount of these compounds is 0.001 to 0.02 mol per liter of the stabilizing solution. The free formaldehyde concentration in the stabilizing solution is preferably as low as possible so as to prevent formaldehyde gas from sublimation. From such a point of view as above, preferred color image stabilizers are m-hydroxybenzaldehyde, hexamethylenetetramine, N-methylolazoles described in J. P. KOKAI No. Hei 4-270344 such as N-methylolpyrazole and azolylmethylamines described in J. P. KOKAI No. Hei 4-313753 such as N,N'-bis(1,2,4-triazol-1-ylmethyl)piperazine. Particularly preferred is a combination of an azole such as 1,2,4-triazole with an azolylmethylamine such as 1,4-bis(1,2,4-triazol-1-ylmethyl)piperazine or a derivative thereof as described in J. P. KOKAI No. Hei 4-359249 (corresponding to European Patent Unexamined Published Application No. 519190 A 2), since a high image stability and a low formaldehyde vapor pressure are realized by the combination. The stabilizing solution preferably contains, if necessary, an ammonium compound such as ammonium chloride or ammonium sulfite, a metal compound of Bi, Al or the like, a fluorescent whitening agent, a hardener, an alkanolamine described in U.S. Pat. No. 4,786,583, and a preservative which can be contained in also the above-described fixing solution and bleach-fixing solution such as a sulfinic acid compound described in J. P. KOKAI No. Hei 1-231051.

Various surfactants can be incorporated into washing water and stabilizing solution so as to prevent the formation of water spots in the course of drying of the photosensitive material. Among them, preferred is an anionic surfactant, particularly an alkylphenol/ethylene oxide adduct. The alkylphenols are particularly preferably octyl-, nonyl-, dodecyl- and dinonylphenols. The molar number of ethylene oxide to be added is particularly preferably 8 to 14. It is also preferred to use a silicon surfactant having a high antifoaming effect.

The washing water and stabilizing solution preferably contain a chelating agent. Preferred chelating agents include aminopolycarboxylic acids such as ethylenediaminetetraacetic acid and diethylenetriaminepentaacetic acid; organic phosphonic acids such as 1-hydroxyethylidene-1,1-diphosphonic acid, N,N,N'-trimethylenephosphonic acid and diethylenetriamine-N,N,N',N'-tetramethylenephosphonic acid; and hydrolyzates of maleic anhydride polymers described in European Patent No. 345,172 A 1.

The overflow obtained during the washing with water and/or replenishing of the stabilizing solution is reusable in other steps such as the desilverizing step.

When each of the above-described processing solutions is concentrated by evaporation in the process with an automatic developing machine, it is preferred to replenish a suitable amount of water, correcting solution or process replenisher in order to compensate the solution for concentration caused by the evaporation. Although the method for replenishing water is not particularly limited, preferred are the following methods: a method described in J. P. KOKAI Nos. Hei 1- 254959 and 1-254960 wherein a monitor water tank which is different from the bleaching tank is provided, the amount of water evaporated from the monitor water tank is determined, the amount of water evaporated from the bleaching tank is calculated from the determined amount of evaporated water, and water is fed into the bleaching tank in proportion to the amount of evaporated water; and a method described in J. P. KOKAI Nos. Hei 3-248155, 3-249644, 3-249645 and 3-249646 wherein the compensation for the evaporation is conducted with a liquid level sensor or overflow sensor. Although water for compensating for the evaporation in each processing solution may be tap water, deionized water or sterilized water preferably used in the above-described water washing steps is preferred.

Water processed with a reverse osmosis membrane is effectively usable for washing and/or stabilization. The materials usable for preparing the reverse osmosis membrane are, for example, cellulose acetate, crosslinked polyamides, polyethers, polysulfons, polyacrylic acids and polyvinylene carbonates.

From the viewpoints of the effect of prevention from staining and prevention from reduction in amount of passing water, the water-feeding pressure in the reverse osmosis with the membrane is preferably 2 to 10 kg/cm$^2$, particularly preferably 3 to 7 kg/cm$^2$.

The process with the reverse osmosis membrane is preferably conducted for water to be used in the second tank and/or a tank arranged thereafter for the washing in the multi-stage counter-current system and/or stabilization. In particular, when two tanks are used, the treated water is used in the second tank; when three tanks are used, the treated water is used in the second or third tank; and when four tanks are used, water in the third or fourth tank is treated with the reverse osmosis membrane and water passed through the membrane is returned into that tank (the tank from which the water to be treated with the reverse osmosis membrane was taken; hereinafter referred to as "tank from which water was taken") or into subsequent tank for washing with water and/or stabilization tank. In an embodiment, concentrated washing water and/or stabilizing solution is returned into a bleach-fixing bath on upstream side.

Each processing solution is used preferably at 10° to 50° C. Although the standard temperature ranges from 33° to 38° C., it is also possible to accelerate the process and thereby to reduce the process time at a higher temperature or, on the contrary, to conduct the process at a lower temperature so as to improve the image quality and stability of the processing solution.

Each processing solution is usable for processing two or more kinds of photosensitive materials. For example, a color negative film and a color paper are processed with the same solution to reduce the cost of the processing machine and to simplify the process.

The solutions are suitably used for various color photosensitive materials such as general color negative films, color negative films for movies, color reversal films for slides or televisions, color papers, color positive films and color reversal papers. They are suitable also for film units having a lens described in J. P. KOKOKU No. Hei 2-32615 and Japanese Utility Model Publication for Opposition Purpose No. Hei 3-39784.

At least one photosensitive layer is formed on a support to form the photosensitive material. A typical example of the silver halide photosensitive material comprises at least one photosensitive layer (comprising two or more silver halide emulsion layers having substantially the same color sensitivity but different degree of sensitivity) formed on the support. The photosensitive layer is a unit photosensitive layer sensitive to any of blue, green and red lights. In the multi-layered silver halide photosensitive materials for photography, the arrangement of the unit photosensitive layers is usually as follows: a red-sensitive layer, a green-sensitive layer and a blue-sensitive layer in this order from the support. However, the order may be reversed or a sensitive layer may be interposed between two layers sensitive to another color depending on the purpose. A photoinsensitive layer can be provided between the silver halide photosensitive layers or as the top layer or the bottom layer. These layers may contain a coupler, DIR compound or color-mixing inhibitor which will be described below. The two or more silver halide emulsion layers constituting the unit photosensitive layer have preferably a structure consisting of two layers, i.e. a high sensitivity emulsion layer and a low sensitivity emulsion layer, as described in DE 1,121,470 or GB 923,045. Usually the arrangement of the layers is such that the sensitivity thereof decreases gradually toward the support. An emulsion layer having a low sensitivity may be formed away from the support and an emulsion layer having a high sensitivity may be formed close to the support as described in J. P. KOKAI Nos. Sho 57-112751, 62-200350, 62-206541 and 62-206543.

Examples of the arrangement are as follows: a blue-sensitive layer having a low sensitivity (BL)/blue-sensitive layer having a high sensitivity (BH)/green-sensitive layer having a high sensitivity (GH)/green sensitive layer having a low sensitivity (GL)/red-sensitive layer having a high sensitivity (RH)/red-sensitive layer having a low sensitivity (RL); BH/BL/GL/GH/RH/RL; and BH/BL/GH/GL/RL/RH toward the support.

As described in J. P. KOKOKU No. Sho 55-34932, the arrangement may be a blue-sensitive layer/GH/RH/GL/RL toward the support. Another arrangement is a blue-sensitive layer/GL/RL/GH/RH toward the support as described in J. P. KOKAI Nos. Sho 56-252738 and 62-63936.

Another arrangement is that of three layers having sensitivities gradually lowered toward the support, i.e. a top layer (a silver halide emulsion layer having the highest sensitivity), middle layer (a silver halide emulsion layer having a lower sensitivity) and bottom layer (a silver halide emulsion layer having a sensitivity lower than that of the middle layer) as described in J. P. KOKOKU No. Sho 49-15495. Even in such an arrangement comprising three layers having sensitivities different from each other, sensitive layers having the same color may further comprise an emulsion layer having medium sensitivity/emulsion layer having high sensitivity/emulsion layer having low sensitivity in the order toward the support as described in J. P. KOKAI No. Sho 59-202464. In another example, the arrangement may be as follows: high-sensitivity emulsion layer/low sensitivity emulsion layer/medium sensitivity emulsion layer, or low sensitivity emulsion layer/medium sensitivity emulsion layer/high sensitivity emulsion layer. When the photosensitive material has four or more layers, the arrangement of them may be varied as described above.

For improving the color reproducibility, it is preferred to form a donor layer (CL) having an interlayer effect and a spectral sensitivity distribution different from that of the main photosensitive layers such as BL, GL and RL at a position adjacent to or close to the main photosensitive layers as described in U.S. Pat. Nos. 4,663,271, 4,705,744 and 4,707,436 and J. P. KOKAI Nos. Sho 62-160448 and 63-89850.

When the photosensitive material is for prints (color photographic paper), the silver halide grains in the emulsions are spectrally sensitized with the blue-sensitive, green-sensitive and red-sensitive, spectrally sensitizing dyes in the above-described order of layers. This photosensitive material can be prepared by forming these layers in the above-described order on the support. The order of the layers can be changed. Namely, from the viewpoint of rapid process, it is preferred in some cases that the top photosensitive layer contains silver halide grains having the largest average grain size; and from the viewpoint of storability under irradiation with light, it is preferred that the bottom layer comprises a magenta photosensitive layer.

The photosensitive layer and the formed hue may not have the corresponding constitution mentioned above. One or more infrared-sensitive silver halide emulsion layers may also be formed.

Preferred silver halide used for preparing the photosensitive material for photography is silver bromoiodide, silver chloroiodide or silver chlorobromoiodide containing less than about 30 molar % of silver iodide. Particularly preferred is silver bromoiodide or silver chlorobromoiodide containing about 2 to 10 molar % of silver iodide.

The silver halide grains in the photographic emulsion may be in a regular crystal form such as a cubic, octahedral or tetradecahedral form; an irregular crystal form such as spherical or plate form; or a complex crystal form thereof. They include also those having a crystal fault such as a twin plate.

The silver halide grain diameter may range from about 0.2 μm or less to as large as that having a projection area diameter of about 10 μm. The emulsion may be either a polydisperse emulsion or monodisperse emulsion. Preferred is the monodisperse emulsion having a coefficient of dispersion of 15% or below, and more preferred is that having a coefficient of 10% or below.

The silver halide photographic emulsion usable in the present invention can be prepared by processes described in, for example, Research Disclosure (hereinafter referred to as "RD") No. 17643 (December, 1978), pp. 22 to 23, "1. Emulsion preparation and types"; RD No. 18716 (November, 1979), p. 648; and RD No. 307105 (November, 1989), pp. 863 to 865.

Tabular grains having an aspect ratio of 3 or higher are also usable in the present invention. The tabular grains can be easily prepared by processes described in, for example, Gutoff, Photographic Science and Engineering, Vol. 14, pp. 248 to 257 (1970); U.S. Pat. No. 4,434,226; and British Patent No. 2,112,157.

The crystal structure of the grains may be uniform; the grains may comprise an inside portion and an outside portion which are composed of silver halides different from each other; or the structure may be a laminated one. Different silver halide grains can be bonded together by an epitaxial bond or they can be bonded with a compound other than silver halides such as silver rhodanate or lead oxide. A mixture of grains having various crystal forms can also be used.

The emulsion may be of a surface-latent image type for forming a latent image mainly on the surface thereof, of an internal latent image type for forming a latent image in the grains or of such a type that a latent image is formed both on the surface and in the grains. The emulsion must be a negative one. In the internal latent image type emulsions, a core/shell type internal latent image type emulsion described in J. P. KOKAI No. Sho 63-264740 may also be used. Processes for producing such an emulsion are described in J. P. KOKAI No. Sho 59-133542. The thickness of the shells in the emulsion which varies depending on the developing process is preferably 3 to 40 nm, particularly preferably 5 to 20 nm.

The silver halide emulsion to be used in the present invention is usually physically and chemically ripened and spectrally sensitized. The additives to he used in these steps are shown in RD Nos. 17643, 18716 and 307105. The portions in which the additives are mentioned in these three Research Disclosures are summarized in a table given below.

A mixture of two or more photosensitive silver halide emulsions different from one another in at least one of grain size, grain size distribution, halogen components, shape of the grains and sensitivity can be used for forming a layer of the photosensitive material of the present invention.

Silver halide grains having the fogged surface described in U.S. Pat. No. 4,082,553, silver halide grains having fogged interior and colloidal silver described in U.S. Pat. No. 4,626,498 and J. P. KOKAI No. Sho 59-214852 can be preferably used for forming the photosensitive silver halide emulsion layer and/or substantially photo-insensitive, hydrophilic colloid layer. The term "silver halide grains having fogged interior or surface" indicates silver halide grains which can be subjected to uniform (non-imagewise) development irrespective of exposed or non-exposed parts of the photosensitive material. The silver halide for forming the core of the core/shell type silver halide grains having the fogged interior may have the same or different halogen composition. The silver halides having the fogged interior or surface include silver chloride, silver chlorobromide, silver bromoiodide and silver chlorobromoiodide. The average grain size of the fogged silver halide grains is preferably 0.01 to 0.75 μm, particularly 0.05 to 0.6 μm. The grains may be regular or in the form of a polydisperse emulsion. The dispersion is preferably of monodisperse system.

Fine grains of a photo-insensitive silver halide are also usable. The term "fine grains of photo-insensitive silver halide" indicates fine silver halide grains which are not sensitized in the image-forming exposure for forming a dye image and which are substantially not developed in the developing process. They are preferably previously not fogged. The fine silver halide grains have a silver bromide content of 0 to 100 molar %. If necessary, they may contain silver chloride and/or silver iodide. They preferably contain 0.5 to 10 molar % of silver iodide. The fine silver halide grains have an average grain diameter (average diameter of a circle having an area equal to that of the projected area) of preferably 0.01 to 0.5 μm, more preferably 0.02 to 0.2 μm.

It is unnecessary to chemically sensitize or spectrally sensitize the silver halide grains. It is preferred, however, to incorporate a known stabilizer such as a triazole, azaindene, benzothiazolium or mercapto compound or a zinc compound thereinto prior to the incorporation thereof into a coating solution. Colloidal silica can be preferably incorporated into the fine silver halide grain-containing layer.

The amount of silver to be applied to the photosensitive material for photography is preferably 3 to 10 g/m$^2$, most preferably 4 to 7 g/m$^2$.

The silver halide grains in the photosensitive material for prints are preferably silver chloride, silver chlorobromide or silver chlorobromoiodide grains comprising at least 95 molar % of silver chloride. Particularly, for the rapid process, substantially silver iodide-free silver chlorobromide or silver chloride can be preferably used. The term "substantially silver iodide-free" herein indicates that silver iodide content is not higher than 1 molar %, preferably not higher than 0.2 molar %. Further, in some cases, high-silver chloride grains containing 0.01 to 3 molar % of silver iodide on the emulsion surface as described in J. P. KOKAI No. Hei 3-84545 are preferably used so as to improve the high-intensity sensitivity, spectral sensitivity or storability of the photosensitive material. Although the halogen composition of the emulsion may be the same or different among the grains, the properties of all the grains can be easily made uniform by using an emulsion of grains having a uniform halogen composition. As for the halogen composition distribution in the silver halide grains in the emulsion, grains can be suitably selected from among those having a so-called homogeneous structure in which the composition in any part of the grain is uniform; those having a so-called laminated structure in which the halogen composition in the core of the silver halide grain is different from that in the shell (one or more layers) surrounding the core; and those having a structure which has a non-layer part having a different halogen composition in the interior or on the surface (when such a ion-layer part is on the surface of the grain, the structure is such that the different composition part is joined to the edge, corner or surface of the grain). To obtain a high sensitivity, grains having either of the latter two structures are preferred to the grains of the homogeneous structure. Those of the latter structures are preferred also from the viewpoint of the pressure resistance. When the silver halide grains have such a structure, the boundary between the parts each having a different halogen composition may be clear or, on the contrary, it may be made unclear by forming mixed crystals from compositions different from each other. Further, the structure may be positively made such that the composition gradually changes within the grain.

In an emulsion having a high silver chloride content, the grains preferably have such a structure that silver bromide local phase in the form of a layer or non-layer is contained in the silver halide grain and/or on the surface thereof. As for the halogen composition in the local phase, silver bromide content is preferably at least 10 molar %, more preferably at least 20 molar %. The local phase can be in the grain, at an edge or corner of the grain surface or on the grain surface. In a preferred embodiment, the local phase is epitaxially grown at a corner of the grain.

It is also effective to further increase the silver chloride content of the silver halide emulsion for the purpose of reducing the amount of the developer replenisher. In such a case, an emulsion comprising substantially pure silver chloride, i.e. an emulsion having a silver chloride content of 98 to 100 molar %, is also preferably used.

The average grain size (number-average diameter of a circle having an area equal to that of the projected area) of the silver halide grains contained in the silver halide emulsion is preferably 0.1 to 2 μm.

As for the grain size distribution, the coefficient of variation (calculated by dividing the standard deviation of the grain size distribution by the average grain size) is not higher than 20%, desirably not higher than 15%, and more desirably not higher than 10%. Namely, the emulsion is so-called monodisperse emulsion. In order to obtain a wide latitude, this monodisperse emulsion is preferably blended in the same layer or multi-coated.

The silver halide grains in the photographic emulsion may be in a regular crystal form such as a cubic, tetradecahedral or octahedral form; an irregular crystal form such as spherical or plate form; or a complex crystal form thereof. They include also a mixture of various crystal forms. In the present invention, it is preferred that at least 50%, preferably at least 70% and more preferably at least 90%, of the grains have the regular crystal forms. An emulsion in which more than 50% (in terms of the projected area), based on the whole grains, of tabular grains have an average aspect ratio (diameter of the corresponding circle/thickness) of at least 5, preferably at least 8, is suitably usable.

The localized silver halide grain phase or its emulsion substrate may contain a different metal ion or complex ion thereof. Preferred are those selected from among ions and complexes of metals of the Groups VIII and IIb in the Periodic table, and lead ion and thallium ion. The localized phase mainly contains an ion or complex ion of a metal selected from among iridium, rhodium and iron, and the emulsion substrate mainly contains an ion or complex ion of a metal selected from among osmium, iridium, rhodium, platinum, ruthenium, palladium, cobalt, nickel and iron. The kind and concentration of the metal ion in the locallized phase may be different from those in the emulsion substrate. A combination of two or more kinds of these metals can e used. It is particularly preferred that the iron and iridium compounds are in the silver bromide locallized phase.

The metal ion-donating compound is incorporated into the localized silver halide grain phase and/or the other part of the grain emulsion substrate by adding it to an aqueous gelatin solution to be used as the dispersion medium, to an aqueous halide solution, to an aqueous silver salt solution or to another aqueous solution in the course of forming the silver halide grains; or by using the compound in the form of fine silver halide grains containing the metal ion and dissolving the fine grains.

The metal ion used in the present invention can be incorporated into the grains in the emulsion before, during or immediately after the formation of the grains. The time of the incorporation can be changed depending on the position of the metal ion in the grain.

The silver halide emulsion is usually chemically and spectrally sensitized.

The chemical sensitization is conducted with a chalcogen sensitizer (in particular, sulfur sensitization typified by the addition of an unstable sulfur compound, selenium sensitization with a selenium compound or tellurium sensitization with a tellurium compound). A noble metal sensitization typified by gold sensitization and reduction sensitization can be conducted either separately or in combination of them. Compounds preferably used for the chemical sensitization are those described from the right lower column of page 18 to the right upper column on p. 22 of J. P. KOKAI No. Sho 62-215272.

The effect obtained by the constitution of the photosensitive material of the present invention is more remarkable than that obtained by using a high-silver chloride emulsion sensitized with gold. The emulsion used in the present invention is of a so-called surface latent image-type, wherein the latent image is formed mainly on the grain surface.

The silver halide emulsion can contain various compounds or precursors thereof so as to prevent the fogging during the production, storage or processing of the photosensitive material, or to stabilize the photographic properties. Preferred examples of these compounds are described on pages 39 to 72 of the above-mentioned J. P. KOKAI No. Sho 62-215272. Further, 5-arylamino-1,2,3,4-thiatriazole compounds (the aryl residue has at least one electron-attractive group) described in European Patent No. 0447647 are also preferably used.

The spectral sensitization is conducted for the purpose of imparting a spectral sensitivity in a desired wavelength range to the emulsion for forming each layer of the photosensitive material.

The spectral sensitizing dyes used for the spectral sensitization in blue, green and red zones include, for example, those described in F. M. Harmer, Heterocyclic compounds—Cyanine dyes and related compounds (published by John Wiley & Sons [New York, London] in 1964). Examples of the preferred compounds and the spectral sensitization method are described from the right upper column, page 22 to page 38 of the above-mentioned J. P. KOKAI No. Sho 62-215272. As for the red-sensitive spectral sensitizing dyes for the silver halide grains having a high silver chloride content, spectral sensitizing dyes described in J. P. KOKAI No. Hei 3-123340 are very excellent in the stability, adhesion strength and dependence of the exposure on the temperature.

For the efficient spectral sensitization of the infrared zone, sensitizing dyes described from the left upper column, page 12 to the left lower column, page 21 of J. P. KOKAI No. Hei 3-15049; from the left lower column, page 4 to the left lower column, page 15 of J. P. KOKAI No. Hei 3-20730; from line 21, page 4 to line 54, page 6 of European Patent No. 0,420,011; from line 12, page 4 to line 33, page 10 of European Patent No. 0,420,012; European Patent No. 0,443,466 and U.S. Pat. No. 4,975,362 are preferably used.

The spectrosensitizing dye can be added to the emulsion in any stage of the preparation of the emulsion, which has been known to be suitable for the addition. Namely, this dye can be added in any of the following stages: before the formation of the grains of the silver halide emulsion, during the formation thereof, immediately after the formation of the grains and before the step of washing with water, before or during the chemical sensitization, immediately after the chemical sensitization and before the solidification of the emulsion by cooling, and during the preparation of the coating solution. The spectrosensitizing dye is usually added after the completion of the chemical sensitization and before the application of the coating solution. It is also possible to add the spectrosensitizing dye together with the chemical sensitizer to conduct the spectral sensitization and chemical sensitization at the same time as described in U.S. Pat. Nos. 3,628,969 and 4,225,666; to conduct the spectral sensitization prior to the chemical sensitization as described in J. P. KOKAI No. Sho 58-113928; and to add the spectrosensitizing dye before the completion of the precipitation of the silver halide grains to start the spectral sensitization. The spectrosensitizing dye can be added in portions as suggested in U.S. Pat. No. 4,225,666. Namely, a part of this dye is added prior to the chemical sensitization and the balance is added after the completion of the chemical sensitization. Thus, the addition can be conducted in any stage of the formation of the silver halide grains as in a method described in U.S. Pat. No. 4,183,756. It is particularly preferred to add the spectrosensitizing dye before the step of washing the emulsion with water or before the chemical sensitization.

The amount of the spectrosensitizing dye is determined as occasion demands in a wide range of preferably $0.5\times10^{-6}$ to $1.0\times10^{-2}$ mol, more preferably $1.0\times10^{-6}$ to $5.0\times10^{-3}$ mol, per mol of the silver halide.

When a sensitizing dye having a spectral sensitivity particularly in the range of red zone to infrared zone is used, the dye is preferably used in combination with a compound described from the right lower column, page 13 to the right lower column, page 22 of J. P. KOKAI No. Hei 2-157749. By using such a compound, the storability of the photosensitive material, stability of the process and supersensitizing effect can be specifically improved. It is particularly preferred to use the dye in combination with a compound of the general formula (IV), (V) or (VI) given in J. P. KOKAI No.

Hei 2-157749. Such a compound is used in an amount of $0.5\times10^{-5}$ to $5.0\times10^{-2}$ mol, more preferably $5.0\times10^{-5}$ to $5.0\times10^{-3}$ mol, per mol of the silver halide. The compound is used in an amount of advantageously 0.1 to 10.000 mol, more advantageously 0.5 to 5,000 mol, per mol of the sensitizing dye.

A dye (particularly oxonol or cyanine dye) which can be decolored by the process as described on pages 27 to 76 of European Patent No. 0,337,490 A2 can be incorporated into the hydrophilic colloid layer for the purpose of preventing the irradiation or halation or improving the safety of the safelight.

Some of the water-soluble dyes impair the color separation or safety of the safelight when they are used in an increased amount. Preferred dyes usable without impairing the color separation are water-soluble dyes described in Japanese Patent Application Nos. Hei 03-310143, 03-310189 and 03-310139.

A colored layer which can be decolored by processing can be used in place of the water-soluble dye or in combination with this dye. The colored layer which can be decolored by processing may be directly brought into contact with the emulsion layer or, alternatively, it may be positioned via an intermediate layer containing a color-mixing preventing agent such as gelatin or hydroquinone. The colored layer is preferably positioned below (on the support side) the emulsion layer capable of developing a primary color similar to the color of the colored layer. It is possible to form a color layer corresponding to each primary color, or to form color layers corresponding to some of the primary colors. It is also possible to form a color layer corresponding to two or more primary color zones. As for the optical reflection density of the color layer, the optical density at a wavelength at which the highest optical density is attained in the wavelength range for the exposure (i.e. visible ray region of 400 to 700 nm in a usual exposure with a printer, or the wavelength of a scanning exposure light source in the scanning exposure) is preferably 0.2 to 3.0, more preferably 0.5 to 2.5, and particularly 0.8 to 2.0.

For forming the color layer, a method known in the art can be employed. The methods are, for example, a method wherein a dye in the form of solid fine particle dispersion such as a dye described from the right upper column, page 3 to page 8 of J. P. KOKAI No. Hei 2-282244 or a dye described from the right upper column, page 3 to the left lower column, page 11 of J. P. KOKAI No. Hei 3-7931 is incorporated into the hydrophilic colloid layer; a method wherein an anionic dye is mordanted with a cationic polymer; a method wherein a dye is adsorbed on fine particles of a silver halide or the like and is thus fixed in the layer; and a method wherein colloidal silver is used as described in J. P. KOKAI No. Hei 1-239544. As the method wherein a fine powder of a dye is dispersed in the solid form, J. P. KOKAI No. Hei 2-308244 (see pages 4 to 13) describes a method wherein a fine dye powder which is substantially water-insoluble at a pH of 6 or below and substantially water-soluble at a pH of 8 or above is used. The method wherein an anionic dye is mordanted with a cationic polymer is described on pages 18 to 26 of J. P. KOKAI No. Hei 2-84637. Methods for producing colloidal silver used as a photoabsorbent is described in U.S. Pat. Nos. 2,688,601 and 3,459,563. Among these methods, the method wherein the fine dye powder is incorporated or the method wherein the colloidal silver is used is preferred.

Gelatin is advantageously used as the binder or protective colloid for the photosensitive materials. Other hydrophilic colloids can also be used either singly or in combination with gelatin. Preferred gelatin is a low-calcium gelatin having a calcium content of at most 800 ppm, more preferably at most 200 ppm. An antifungal agent as described in J. P. KOKAI No. Sho 63-271247 is preferably used in order to prevent various fungi and bacteria which propagate in the hydrophilic colloid layer to deteriorate the image.

In the printer exposure of the photosensitive material for printing, a band stop filter described in U.S. Pat. No. 4,880,726 is preferably used for eliminating the photo-color-mixing and also for remarkably improving the color reproducibility.

After the completion of the exposure, the photosensitive material can be subjected to an ordinary color development process. To rapidly conduct the process, it is preferred to conduct bleach-fixing after the color development. Particularly when the above-described high-silver chloride emulsion is used, the pH of the bleach-fixing solution is preferably not higher than about 6.5, particularly not higher than about 6, for accelerating the desilverization.

The photographic additives usable herein are also mentioned in RD, and the corresponding portions are also shown in the following table:

| Additive | RD 17643 | RD 18716 | RD 307105 |
|---|---|---|---|
| 1. Chemical sensitizer | p. 23 | p. 648, right column | p. 866 |
| 2. Sensitivity improver | | p. 648, right column | |
| 3. Spectral sensitizer and supersensitizer | pp. 23 to 24 | p. 648, right colum to p. 649, right column | pp. 866 to 868 |
| 4. Brightening agent | p. 24 | p. 647, right column | p. 868 |
| 5. Light absorber, filter, dye and UV absorber | pp. 25 to 26 | p. 649, right column to p. 650, left column | p. 873 |
| 6. Binder | p. 26 | p. 651, left column | pp. 873 to 874 |
| 7. Plasticizer and lubricant | p. 27 | p. 650, right column | p. 876 |
| 8. Coating aid and surfactant | pp. 26 and 27 | p. 650, right column | pp. 875 to 876 |
| 9. Antistatic agent | p. 27 | p. 650, right column | pp. 876 to 877 |
| 10. Matting agent | | | pp. 878 to 879 |

The photosensitive material can contain various dye-forming couplers. Among them, the following couplers are particularly preferred:

Yellow couplers: couplers represented by formulae (I) and (II) in EP 502,424A; those of formulae (I) and (II) in E.P. No. 513,496A (particularly Y-28 on page 18); those of general formula (I) in Claim 1 of Japanese Patent Application No. Hei 4-134523; those of general formula (I) in lines 45 to 55, column 1 of U.S. Pat. No. 5,066,576; those of general formula (I) in paragraph 0008 of J. P. KOKAI No. Hei 4-274425; those set forth in Claim 1, on p. 40 of E. P. No. 498,381A1 [particularly D-35 on p. 18); those of formula (Y) on p. 4 of E. P. No. 447,969A1 [particularly Y-1 on p. 17 and Y-54 on p. 41); and those of general formulae (II) to (IV) in lines 36 to 58, column 7 of U.S. Pat. No. 4,476,219 [particularly II-17, 19 (column 17) and II-24 (column 19)], Acylacetanilide couplers: particularly pivaloylacetanilide couplers having a halogen atom or alkoxyl group at the o-position of the anilide ring; acylacetanilide couplers wherein the acyl group is a cycloalkanecarbonyl group having a substituent at the 1-position as described in E. P. No. 0,447,969A and J. P. KOKAI Nos. Hei 5-107701 and 5-113642; and malondianilide couplers described in E. P. Nos. 0,482,552A and 0,524,540A, Magenta couplers: those described in J. P. KOKAI No. Hei 3-39737 [L-57 (right lower column, p. 11), L-68 (right lower column, p. 12) and L-77 (right lower column, p. 13); [A-4]-63 (p. 134), [A-4]-73 and 75 (p. 139) of E. P. No. 456,257; M-4 and 6 (p. 26) and M-7 (p. 27) of E. P. No. 486,965; M-45 in paragraph 0024 of Japanese Patent Application No. Hei 4-234120; M-1 in paragraph 0036 of Japanese Patent Application No. Hei 4-36917; and M-22 in paragraph 0237 of J. P. KOKAI No. Hei 4-362631, 5-Pyrazolone magenta couplers: those of arylthio-linked coupling-off type described in W.O. 92/18901, 92/18902 and 92/18903, Pyrazoloazole couplers: those containing a sulfonamido group in the molecule as described in J. P. KOKAI No. Sho 61-65246; those having an alkoxyphenylsulfonamido ballast group as described in J. P. KOKAI No. Sho 61-147254; and those having an alkoxy or aryloxy group at the 6-position as described in European Patent Nos. 226,849A and 294,785A, Cyan couplers: CX-1, 3, 4, 5, 11, 12, 14 and 15 (pp. 14 to 16) of J. P. KOKAI No. Hei 4-204843; C-7 and 10 (p. 35), 34 and 35 (p. 37),, (I-1) and (I-17) (pp. 42 to 43) of J. P. KOKAI No. Hei 4-43345; and those of general formula (Ia) or (Ib) in Claim 1 of Japanese Patent Application No. Hei 4-236333, Polymer couplers: P-1 and P-5 (p. 11) of J. P. KOKAI No. Hei 2-44345, and Phenol couplers and naphthol couplers; diphenylimidazole cyan couplers described in J. P. KOKAI No. Hei 2-33144; 3-hydroxypyridine cyan couplers described in E. P. No. 0,333,185A2; cyclic active methylene cyan couplers described in J. P. KOKAI No. Sho 64-32260; pyrrolopyrazole cyan couplers described in E. P. No. 0,456,226A1; pyrroloimidazole cyan couplers described in E. P. No. 0,484, 909; and pyrrolotriazole cyan couplers described in E. P. Nos. 0488,248 and 0,491,197A1.

The couplers capable of forming a colored dye having a suitable diffusibility are preferably those described in U.S. Pat. No. 4,366,237, G.B. Patent No. 2,125,570, E. P. No. 96,873B and DE P. No. 3, 234,533.

The couplers used for compensation for unnecessary absorption of the colored dye are preferably as follows: yellow-colored cyan couplers of formulae (CI), (CII), (CIII) and (CIV) on p. 5 of E. P. No. 456,257A1 (particularly YC-86 on p. 84); yellow-colored magenta coupler ExM-7 (p. 202), EX-1 (p. 249) and EX-7 (p. 251) described in E. P. No. 456,257A1; magenta-colored cyan coupler CC-9 (column 8) and CC-13 (column 10) described in U.S. Pat. No. 4,833,069; couplers (2) (column 8) in U.S. Pat. No. 4,837, 136; and colorless masking couplers of formula (A) in Claim 1 of WO 92/11575 (particularly compounds given on pages 36 to 45).

Compounds (including couplers) capable of reacting with an oxidation product of the developing agent to form a photographically useful compound residue are as follows: development inhibitor-releasing compounds such as compounds of formulae (I), (II), (III) and (IV) on page 11 of E. P. No. 378,236A1 [particularly compounds T-101 (p. 30), T-104 (p. 31), T-113 (p. 36), T-131 (p. 45), T-144 (p. 51) and T-158(p. 58)], compounds of formula (I) on page 7 of E. P. No. 436,938A2 [particularly D-49 (p. 51)], compounds of formula (1) in Japanese Patent Application No. Hei 4-134523 [particularly (23) in paragraph 0027], compounds of formulae (I), (II) and (III) on pages 5 to 6 of E. P. No. 440,195A2 [particularly I-(1) on page 29]; bleaching accelerator-releasing compounds such as compounds of formulae (I) and (I') on page 5 of E. P. No. 310,125A2 [particularly (60) and (61) on p. 61] and compounds of formula (I) in Claim 1 of Japanese Patent Application No. Hei 4-325564 [particularly (7) in paragraph 0022]; ligand-releasing compounds such as those of LIG-X in Claim 1 of U.S. Pat. No. 4,555,478 (particularly compounds in lines 21 to 41 in column 12); leuco dye-releasing compounds such as compounds 1 to 6 in columns 3 to 8 of U.S. Pat. No. 4,749,641; fluorescent dye-releasing compounds such as compounds represented by COUP-DYE in Claim 1 of U.S. Pat. No. 4,774,181 (particularly compounds 1 to 11 in columns 7 to 11); development accelerator- or fogging agent-releasing compounds such as those of formulae (1), (2) and (3) in U.S. Pat. No. 4,656,123 [particularly (I-22) in column 25] and ExZK-2 in lines 36 to 38 on page 75 of E. P. No. 450,637A2; compounds which do not release a dye-forming group before coupling-off such as compounds of formula (I) in Claim 1 of U.S. Pat. No. 4,857,447 (particularly Y-1 to Y-19 in columns 25 to 36).

As additives other than the couplers, those described below are preferred.

Dispersion medium for oil-soluble organic compounds: P-3, 4,16, 19, 25, 30, 42, 49, 54, 55, 66, 81, 85, 86 and 93 (pp. 140 to 144) described in J. P. KOKAI Sho 62-215272; latices for impregnation of oil-soluble organic compounds: latices described in U.S. Pat. No. 4,199,363; oxidized developing agent scavengers: compounds of formula (I) in lines 54 to 62, column 2 of U.S. Pat. No. 4,978,606 [particularly 1-(1), (2), (6), (12) in columns 4 and 5] and those of formulae in lines 5 to 10, column 2 of U.S. Pat. No. 4,923,787 [particularly compound 1 (column 3)]; antistaining agents: those of formulae (I) to (III) in lines 30 to 33, p. 4 of E. P. No. 298,321A, particularly I-47, 72, III-1 and 27 (pp. 24 to 48); discoloration inhibitors: A-6, 7, 20, 21, 23, 24, 25, 26, 30, 37, 40, 42, 48, 63, 90, 92, 94 and 164 of E. P. No. 298,321A (pp. 69 to 118), II-1 to III-23 in columns 25 to 38 of U.S. Pat. No. 5,122,444, particularly III-10, I-1 to III-4 on pp. 8 to 12 of E. P. No. 471,347A, particularly II-2, and A-1 to 48 in columns 32 to 40 of U.S. Pat. No. 5,139,931, particularly A-39 and 42; materials capable of reducing the amount of developing improver or color mixing-inhibitor used: I-1 to II-15 on pp. 5 to 24 of E. P. No. 411,324A, particularly I-46; formalin scavengers: SCV-1 to 28 on pp. 24 to 29 of E. P. No. 477,932A, particularly SCV-8; hardeners: H-1, 4, 6, 8 and 14 on p. 17 of J. P. KOKAI No. Hei 1-214845, and compounds (H-1 to 54) of formulae (VII) to (XII) in columns 13 to 23 of U.S. Pat. No. 4,618,573, compounds (H-1 to 76) of formula (6) in the right, lower part on p. 8 of J. P. KOKAI No. Hei 2-214852, particularly H-14, and compounds set forth in Claim 1 of U.S. Pat. No. 3,325,287; development inhibitor precursors: P-24, 37 and 39 (pp. 6 and 7) of J. P. KOKAI No. Sho 62-168139; and compounds set forth in Claim 1 of U.S. Pat. No. 5,019,492, particularly 28 and 29 in column 7; antiseptics and mildew-proofing agents: I-1 to III-43 in columns 3 to 15 of U.S. Pat. No. 4,923,790, particularly II-1, 9, 10, 18 and III-25; stabilizers and antifoggants: I-1 to (14) in columns 6 to 16 of U.S. Pat. No. 4,923,793, particularly I-1, 60, (2) and (13), and compounds 1 to 65 in columns 25 to 32 of U.S. Pat. No. 4,952,483, particularly 36; chemical sensitizers: triphenylphosphine selenide and compound 50 of J. P. KOKAI No. Hei 5-40324; dyes: a-1 to b-20 on pp. 15 to 18 of J. P. KOKAI No. Hei 3-156450, particularly a-1, 12, 18, 27, 35, 36, b-5, V-1 to 23 on pp. 27 to 29, particularly V-1, F-I-1 to F-II-43 on pp. 33 to 55 of E. P. No. 445,627A, particularly F-I-11 and F-II-8, III-1 to 36, on pp. 17 to 28 of E. P. No. 457,153A, particularly III-1 and 3, fine crystal dispersions of Dye-1 to 124 on pp. 8 to 26 of WO88/04794, compounds 1 to 22 on pp. 6 to 11 of E. P. No. 319,999A, particularly compound 1, compounds D-1 to 87 of formulae (1) to (3) (pp. 3 to 28) of E. P. No. 519,306A, compounds 1 to 22 (columns 3 to 10) of formula (I) in U.S. Pat. No. 4,268,622, and compounds (1) to (31) of formula (I) of U.S. Pat. No. 4,923,788; and UV absorbers: compounds (18b) to (18r) of formula (1) and 101 to 427 (pp. 6 to 9) of J. P. KOKAI No. 46-3335, compounds (3) to (66) (pp. 10 to 44) of formula (I), compounds HBT-1 to 10 (p. 14) of formula (III) of E. P. No. 520,938A, and compounds (1) to (31) of formula (1) (columns 2 to 9) of E. P. No. 521,823A.

The support used for the photosensitive material for printing may be made of any material such as a glass, paper or plastic film so far as the photographic emulsion layer can be applied thereto. The most preferred is a support of reflection type.

The term "support of reflection type" herein indicates a support having a high reflectivity so as to obtain a clear dye image in the silver halide emulsion layer. The supports of this type include those coated with a hydrophobic resin containing a light-reflecting substance such as titanium oxide, zinc oxide, calcium carbonate or calcium sulfate dispersed therein, and those comprising the hydrophobic resin per se containing the light-reflecting substance. The supports include, for example, a polyethylene-coated paper, polyethylene terephthalate-coated paper, synthetic polypropylene paper, transparent support having a reflective layer or comprising a reflective substance, such as a glass plate, a polyester film such as polyethylene terephthalate, cellulose triacetate or cellulose nitrate film, polyamide film, polycarbonate film, polystyrene film and vinyl chloride resin film. The preferred supports of reflection type used in the present invention are paper supports the both surfaces of which are each coated with a water-resistant resin layer, wherein at least one of the water-resistant resin layers contains fine white pigment particles.

The water-resistant resins used for forming the reflective support are those having a water absorption of not higher than 0.5% by weight, preferably not higher than 0.1% by weight. They include polyolefins such as polyethylene, polypropylene and other ethylene polymers; vinyl polymers and copolymers thereof such as polystyrene, polyacrylate and copolymers of them; and polyesters such as polyethylene terephthalate and polyethylene isophthalate and copolymers thereof. Particularly preferred are polyethylene and polyesters.

The polyethylenes usable herein are high-density polyethylene, low-density polyethylene, linear low-density polyethylene and blends of these polyethylenes. These polyethylene resins preferably have a melt flow rate (hereinafter referred to as "MFR") in the range of 1.2 to 12 g/10 min as determined under conditions 4 in Table 1 of JIS K 7210 before processing. The term "MFR of polyolefin resin before processing" herein indicates MFR of the resin before blending it with a blueing agent or white pigment.

The weight mixing ratio of the water-resistant resin to the white pigment is 98/2 to 30/70, preferably 95/5 to 50/50 and more preferably 90/10 to 60/40. When the white pigment content is below 2% by weight, a sufficient degree of whiteness cannot be obtained and, on the contrary, when it exceeds 70% by weight, the surface smoothness is insufficient for forming the photographic support having a high gloss.

The water-resistant resin layer formed on the support has a thickness of preferably 2 to 200 μm, and more preferably 5 to 80 μm. When it is above 200 μm, problems of the properties of the resin such as cracking due to an increase of the brittleness of the resin are caused. On the other than, when it is below 2 μm, the water proofness which is the essential purpose of coating is insufficient and, in addition, satisfactory degree of whiteness and surface smoothness cannot be obtained at the same time, and the layer becomes too much soft unfavorably.

The thickness of the resin or resin composition layer coating the backside (the side opposite to the photosensitive layer-forming side) of the support is preferably 5 to 100 μm, more preferably 10 to 50 μm. When the thickness is above this range, problems of the properties of the resin such as cracking due to an increase of the brittleness of the resin are caused. When the thickness is below this range, the water proofness which is the essential purpose of coating is insufficient and, in addition, the layer becomes too much soft unfavorably.

From the viewpoints of the cost, producibility, etc. of the reflective support, it is preferred in some cases that photosensitive layer-side of the support is coated with two or more water-resistant resin layers each having a different white pigment content. In this case, among the water-resistant resin coating layers having different white pigment contents, the white pigment content of a water-resistant resin coating layer most close to the support is lower than that of one or more water-resistant resin coating layers formed thereon. In a more preferred embodiment, the reflective support has two or more water-resistant resin coating layers each having a different white pigment content, in which the water-resistant resin coating layer most close to the photosensitive layer has the highest white pigment content. In another preferred embodiment, the reflective support has at least three water-resistant resin coating layers, in which one or more intermediate layers (interposed between that most close to the photosensitive layer and that most close to the support) has the highest white pigment content.

Each of the water-resistant resin layers has a white pigment content of 0 to 70% by weight, preferably 0 to 50% by weight and more preferably 0 to 40% by weight. Among the water-resistant resin layers, a layer having the highest white pigment content contains 9 to 70% by weight, preferably 15 to 50% by weight and still preferably 20 to 40% by weight, of the white pigment. When the white pigment content of this layer is below 9% by weight, the sharpness of the image is poor and, on the contrary, when it is above 70% by weight, cracks are formed in a melt-extruded film.

The thickness of each of the multiple water-resistant resin layers is preferably 0.5 to 50 μm. For example, when the support has two water-resistant resin layers, the thickness of each layer is preferably 0.5 to 50 μm and the total layer thickness is preferably in the above-described range (2 to 200 μm). When the support has three such layers, it is preferred that the thickness of the top layer is 0.5 to 10 μm, that of the intermediate layer is 5 to 50 μm and that of the bottom layer (the layer the closest to the support) is 0.5 to 10 μm. When the thickness of the top or bottom layer is below 0.5 μm, stripes are easily formed by the effect of the white pigment contained in the intermediate layer in a high concentration. On the other hand, when the thickness of the top layer or the bottom layer, particularly the top layer, is above 10 μm, the sharpness is reduced.

The fine white pigment particles are preferably homogeneously dispersed in the reflective layer without forming aggregates of the particles. The degree of distribution can be determined by measuring of the rate (%) of area (Ri) occupied by the fine particles projected in a unit area. The coefficient of variation of the rate of occupied area (%) can be determined as the ratio of the standard deviation (s) of Ri to the average (R) of Ri, i.e. s/R. The coefficient of variation (%) of the fine pigment particles is preferably not more than 0.15, more preferably not more than 0.12 and particularly not more than 0.08 in the present invention.

A support having a secondary diffuse-reflective surface can also be used. The term "secondary diffuse reflectivity" indicates a diffuse reflectivity realized by making the surface having a mirror plane rough to divide the surface into fine mirror planes facing different directions so that the faces of the finely divided surface (mirror planes) are dispersed. As for the roughness of the secondary diffuse-reflective surface, the average three-dimensional roughness, based on the central face is 0.1 to 2 μm, preferably 0.1 to 1.2 μm. The surface roughness frequency for a roughness of at least 0.1 μm is preferably 0.1 to 2,000 cycles/mm, more preferably 50 to 600 cycles/mm. The details of such a support are described in J. P. KOKAI No. Hei 2-239244.

The supports suitable for the photosensitive material are described, for example, on page 28 of the above-described RD. 176413; from right column, page 647 to left column, page 648 of RD. 18716; and on page 879 of RD 307105.

The photosensitive material for the photography has a total thickness of the hydrophilic colloidal layers on the emulsion layer-side of 23 μm or below, preferably 20 μm or below, and particularly 13 to 17 μm. The film-swelling rate $T_{1/2}$ is preferably 5 to 15 seconds. $T_{1/2}$ is defined to be the time required for attaining the thickness of a half (½) of the saturated film thickness, the saturated film thickness being 90% of the maximum thickness of the film swollen with the color developer at 30° C. for 3 minutes and 15 seconds. The film-swelling rate $T_{1/2}$ can be controlled by adding a hardener to gelatin used as the binder or by varying the time conditions after the coating. The swelling rate is preferably 150 to 350%. The swelling rate can be calculated from the maximum thickness of the swollen film obtained under the above-described conditions by the following formula:
[(Maximum thickness of swollen film)-(film thickness)]/(film thickness).

The photosensitive material can have a hydrophilic colloid layer (in other words, back layer) having a total thickness of 2 to 20 μm on dry basis on the opposite side to the emulsion layer. The back layer preferably contains the above-described light absorber, filter dye, ultraviolet absorber, antistatic agent, hardener, binder, plasticizer, lubricant, coating aid, surfactant, etc. The swelling rate of the back layer is preferably 150 to 500%.

EXAMPLES

The following Examples will further illustrate the present invention, which by no means limit the invention.

Example 1

Preparation of multi-layer color photosensitive material:

A multilayer color photosensitive material, which will be referred to as "sample 101", was prepared by forming layers of the following compositions:

(Compositions of photosensitive layers)

Main materials to be used for forming the layers are classified as follows:

ExC: cyan coupler

ExM: magenta coupler

ExY: yellow coupler

ExS: sensitizing dye

UV: ultraviolet absorber

HBS: high-boiling organic solvent

H : gelatin hardener

The numerals for the respective components indicate the amount of coating given by g/m$^2$. Those for silver halides are given in terms of silver. Those for sensitizing dyes are given in terms of molar unit per mol of the silver halide contained in the same layer.

(Sample 101)

| | |
|---|---|
| **The first layer (antihalation layer):** | |
| black colloidal silver | silver 0.18 |
| glatin | 1.60 |
| ExM-1 | 0.11 |
| ExF-1 | $3.4 \times 10^{-3}$ |
| ExF-2 (solid dispersed dye) | 0.03 |
| ExF-3 (solid dispersed dye) | 0.04 |
| HBS-1 | 0.16 |
| **The second layer (intermediate layer):** | |
| ExC-2 | 0.055 |
| UV-1 | 0.011 |
| UV-2 | 0.030 |
| UV-3 | 0.053 |
| HBS-1 | 0.05 |
| HBS-2 | 0.02 |
| polyethyl acrylate latex | $8.1 \times 10^{-2}$ |
| gelatin | 1.75 |
| **The third layer (low-speed red-sensitive emulsion layer)** | |
| silver bromoiodide emulsion A | silver 0.46 |
| ExS-1 | $5.0 \times 10^{-4}$ |
| ExS-2 | $1.8 \times 10^{-5}$ |
| ExS-3 | $5.0 \times 10^{-4}$ |
| ExC-1 | 0.16 |
| ExC-3 | 0.045 |
| ExC-5 | 0.0050 |
| ExC-7 | 0.001 |
| ExC-8 | 0.010 |
| Cpd-2 | 0.005 |
| HBS-1 | 0.090 |
| gelatin | 0.87 |
| **The fourth layer (medium-speed red-sensitive emulsion layer)** | |
| silver bromoiodide emulsion D | silver 0.70 |
| ExS-1 | $3.0 \times 10^{-4}$ |
| ExS-2 | $1.2 \times 10^{-5}$ |
| ExS-3 | $4.0 \times 10^{-4}$ |
| ExC-1 | 0.22 |
| ExC-2 | 0.055 |
| ExC-5 | 0.007 |
| ExC-8 | 0.009 |
| Cpd-2 | 0.036 |
| HBS-1 | 0.11 |
| gelatin | 0.70 |
| **The fifth layer (high-speed red-sensitive emulsion layer)** | |
| silver bromoiodide emulsion E | silver 1.62 |
| ExS-1 | $2.0 \times 10^{-4}$ |
| ExS-2 | $1.0 \times 10^{-5}$ |
| ExS-3 | $3.0 \times 10^{-4}$ |
| ExC-1 | 0.133 |
| ExC-3 | 0.040 |
| ExC-6 | 0.040 |
| ExC-8 | 0.014 |
| Cpd-2 | 0.050 |
| HBS-1 | 0.22 |
| HBS-2 | 0.10 |
| gelatin | 0.85 |
| **The sixth layer (intermediate layer)** | |
| Cpd-1 | 0.07 |
| ExF-4 | 0.03 |
| HBS-1 | 0.04 |
| polyethyl acrylate latex | 0.19 |

(Sample 101)

| | |
|---|---|
| gelatin | 2.30 |
| The seventh layer (low-speed green-sensitive emulsion layer) | |
| silver bromoiodide emulsion A | silver 0.24 |
| silver bromoiodide emulsion B | silver 0.10 |
| silver bromoiodide emulsion C | silver 0.14 |
| ExS-4 | $4.0 \times 10^{-5}$ |
| ExS-5 | $1.8 \times 10^{-4}$ |
| ExS-6 | $6.5 \times 10^{-4}$ |
| ExM-1 | 0.005 |
| ExM-2 | 0.30 |
| ExM-3 | 0.09 |
| ExY-1 | 0.015 |
| HBS-1 | 0.26 |
| HBS-3 | 0.006 |
| gelatin | 0.80 |
| The eighth layer (medium-speed green-sensitive emulsion layer) | |
| silver bromoiodide emulsion D | silver 0.94 |
| ExS-4 | $2.0 \times 10^{-5}$ |
| ExS-5 | $1.4 \times 10^{-4}$ |
| ExS-6 | $5.4 \times 10^{-4}$ |
| ExM-2 | 0.16 |
| ExM-3 | 0.045 |
| ExY-1 | 0.008 |
| ExY-5 | 0.030 |
| HBS-1 | 0.14 |
| HBS-3 | $8.0 \times 10^{-3}$ |
| gelatin | 0.90 |
| The ninth layer (high-speed green-sensitive emulsion layer) | |
| silver bromoiodide emulsion E | silver 1.29 |
| ExS-4 | $3.7 \times 10^{-5}$ |
| ExS-5 | $8.1 \times 10^{-5}$ |
| ExS-6 | $3.2 \times 10^{-4}$ |
| ExC-4 | 0.011 |
| ExM-1 | 0.016 |
| ExM-4 | 0.046 |
| ExM-5 | 0.023 |
| Cpd-3 | 0.050 |
| HBS-1 | 0.20 |
| HBS-2 | 0.08 |
| polyethyl acrylate latex | 0.26 |
| gelatin | 0.82 |
| The tenth layer (yellow filter layer) | |
| yellow colloidal silver | silver 0.010 |
| Cpd-1 | 0.10 |
| ExF-5 (solid dispersed dye) | 0.06 |
| ExF-6 (solid dispersed dye) | 0.06 |
| ExF-7 (oil-soluble dye) | 0.005 |
| HBS-1 | 0.055 |
| gelatin | 0.70 |

(Sample 101)

| | |
|---|---|
| The eleventh layer (low-speed blue-sensitive emulsion layer) | |
| silver bromoiodide emulsion A | silver 0.25 |
| silver bromoiodide emulsion C | silver 0.25 |
| silver bromoiodide emulsion D | silver 0.10 |
| ExS-7 | $8.0 \times 10^{-4}$ |
| ExY-1 | 0.010 |
| ExY-2 | 0.70 |
| ExY-3 | 0.055 |
| ExY-4 | 0.006 |
| ExY-6 | 0.075 |
| ExC-7 | 0 040 |
| HBS-1 | 0.25 |
| gelatin | 1.60 |
| The twelfth layer (high-speed blue-sensitive emulsion layer) | |
| silver bromoiodide emulsion F | silver 1.30 |
| ExS-7 | $3.0 \times 10^{-4}$ |
| ExY-2 | 0.15 |
| ExY-3 | 0.06 |
| HBS-1 | 0.070 |
| gelatin | 1.13 |
| The thirteenth layer (the first protective layer) | |
| UV-2 | 0.08 |
| UV-3 | 0.11 |
| UV-4 | 0.26 |
| HBS-1 | 0.09 |
| gelatin | 1.20 |
| The fourteenth layer (the second protective layer) | |
| silver bromoiodide emulsion G | silver 0.10 |
| H-1 | 0.30 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| gelatin | 1.75 |

Further, the respective layers suitably contain W-1 to W-3, B-4 to B-6, F-1 to F-17, iron salts, lead salts, gold salts, platinum salts, iridium salts, palladium salts and rhodium salts in order to improve the storability, processability, pressure resistance, mildew-proofing and bacteria-proofing properties, antistatic properties and coating easiness.

TABLE 1

| Emulsion | Average AgI content (%) | Average grain diameter (μm) | Coefficient of variation of grain diameter (%) | Rate of grains having diameter/thickness ratio of at least 2 (%) | Grain structure/shape |
|---|---|---|---|---|---|
| A | 2.1 | 0.55 | 25 | 81 | homogeneous structure, tabular |
| B | 9.1 | 0.63 | 26 | 84 | triple structure, tabular |
| C | 3.1 | 0.60 | 24 | 98 | triple structure, tabular |
| D | 4.2 | 0.80 | 19 | 92 | triple structure, tabular |
| E | 3.2 | 1.10 | 17 | 96 | triple structure, tabular |
| F | 10.8 | 1.75 | 27 | 60 | double structure, tabular |
| G | 1 | 0.07 | 15 | 0 | homogeneous structure, cubic |

In Table 1:

(1) The emulsions A to F were reduction-sensitized with thiourea dioxide and thiosulfonic acid in the step of preparation of the grains as described in an Example of J. P. KOKAI No. Hei 2-191938.

(2) The emulsions A to F were sensitized by gold sensitization, sulfur sensitization and selenium sensitization methods in the presence of a spectral sensitizing dye mentioned above for each photosensitive layer and sodium thiocyanate as described in an Example of J. P. KOKAI No. Hei 3-237450.

(3) In the preparation of tabular grains, a low-molecular weight gelatin was used as described in an Example of J. P. KOKAI No. Hei 1-158426.

(4) Dislocation lines as described in J. P. KOKAI No. Hei 3-237450 were observed on the tabular grains with a high-voltage electron microscope.

Preparation of dispersion of organic solid disperse dye:

ExF-2 which will be described below was dispersed as follows: 21.7 ml of water, 3 ml of 5% aqueous solution of sodium p-octylphenoxyethoxyethanesulfonate and 0.5 g of 5% aqueous solution of p-octylphenoxy polyoxyethylene ether (degree of polymerization: 10) were fed into a 700 ml pot mill. 5.0 g of dye ExF-2 and 500 ml of zirconium oxide beads (diameter: 1 mm) were added thereto, and the mixture was milled with a BO type vibration ball mill (a product of Chuo Koki) for 2 hours to obtain a dispersion. Then the dispersion was taken out and added to 8 g of 12.5% aqueous gelatin solution. The beads were removed by filtration to obtain a dispersion of the dye in gelatin. The average grain diameter of the fine dye grains was 0.44μm.

A solid dispersion of each of ExF-3, ExF-4 and ExF-6 was obtained in the same manner as that described above. The average grain diameters of the fine dye grains were 0.24 μm, 0.45 μm and 0.52 μm, respectively. ExF-5 was dispersed by a microprecipitation dispersion method described in Example 1 in E. P. No. 0,549,489 A. The average grain diameter was 0.06 μm.

ExC-1

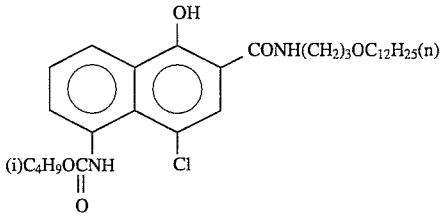

ExC-2

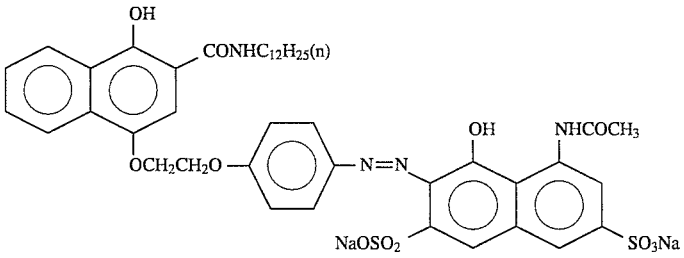

ExC-3

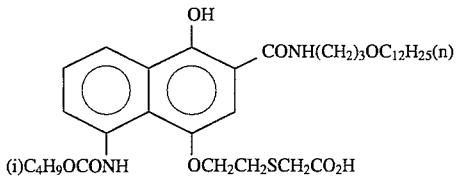

ExC-4

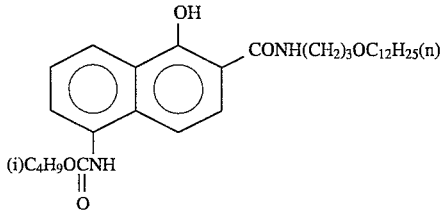

-continued
ExC-5
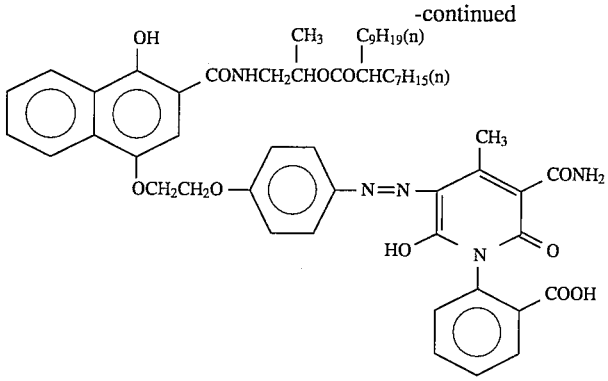
ExC-7
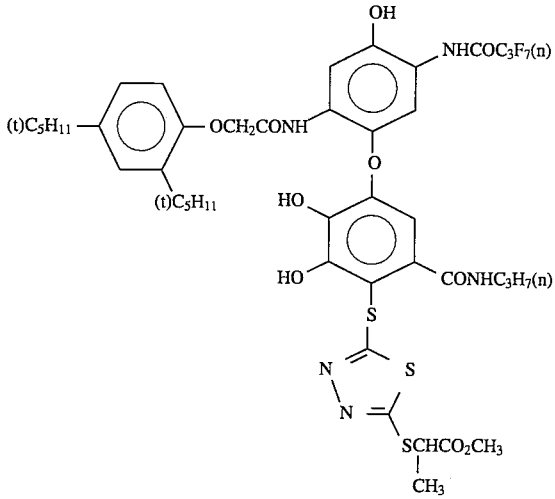
ExC-8
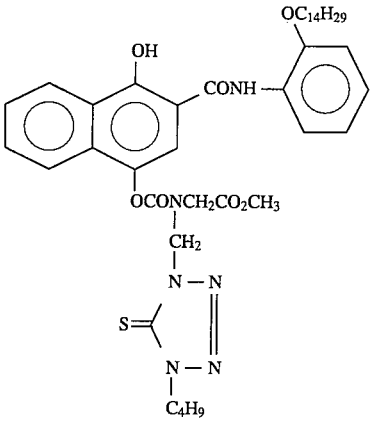
ExM-1
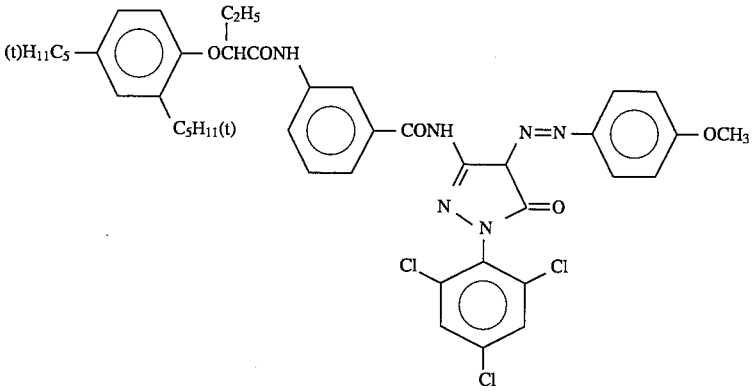

-continued
ExM-2
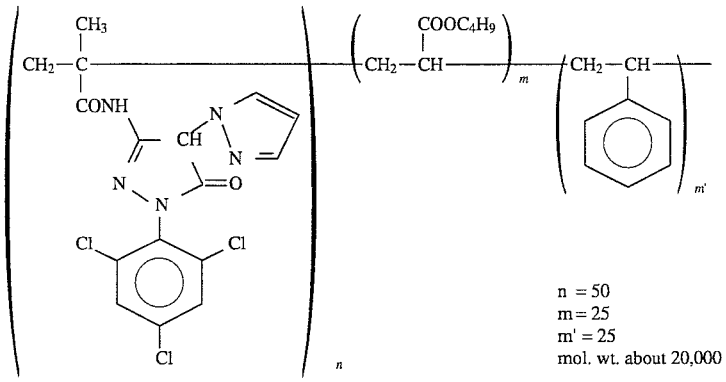
n = 50
m = 25
m' = 25
mol. wt. about 20,000
ExM-3
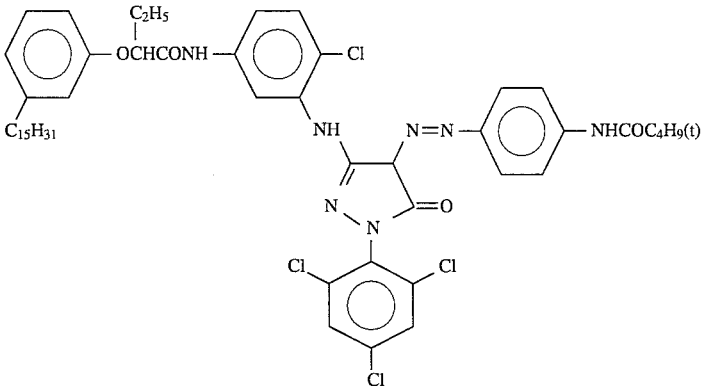
ExM-4
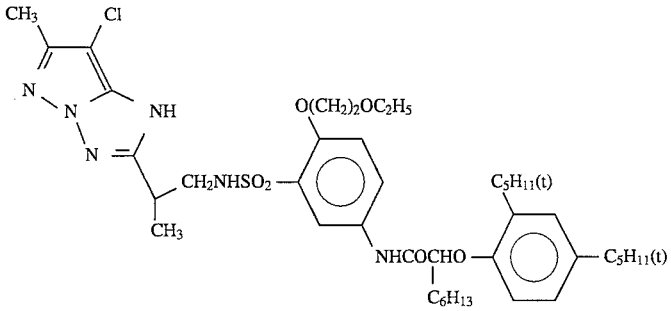
ExM-5
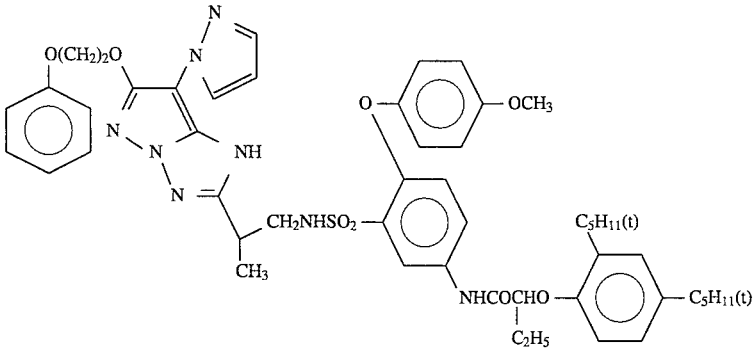

-continued
ExY-1
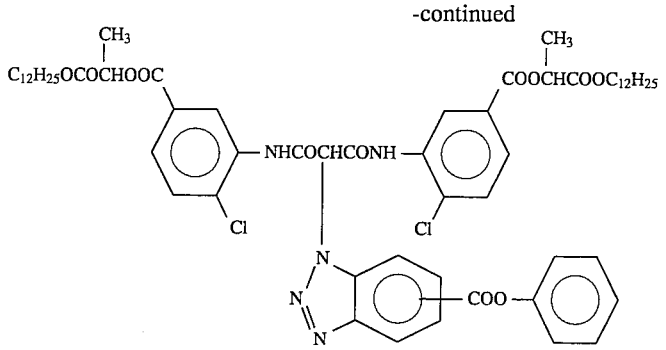
ExY-2
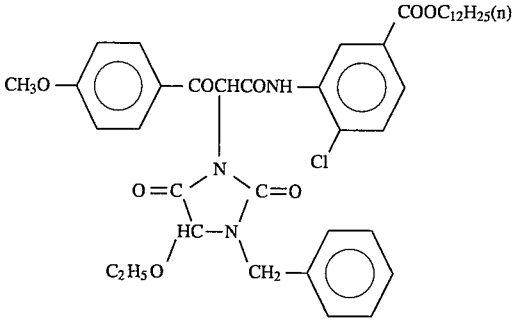
ExY-3
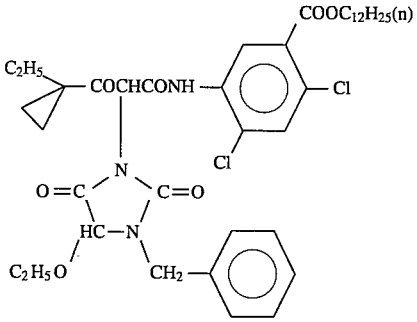
ExY-4
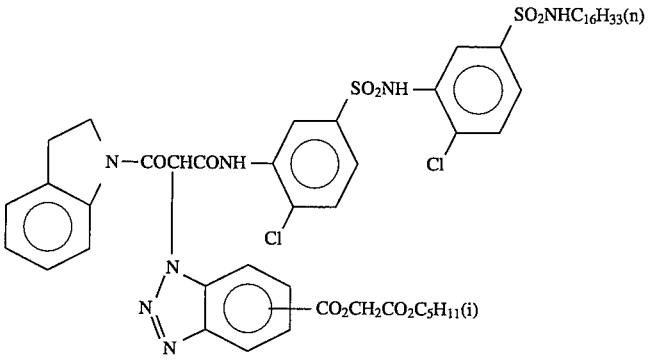
ExY-5
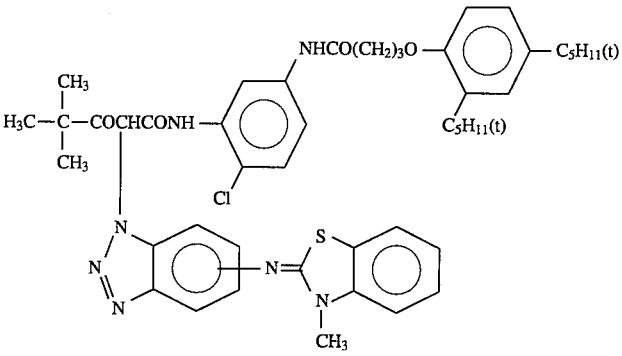

-continued
ExY-6
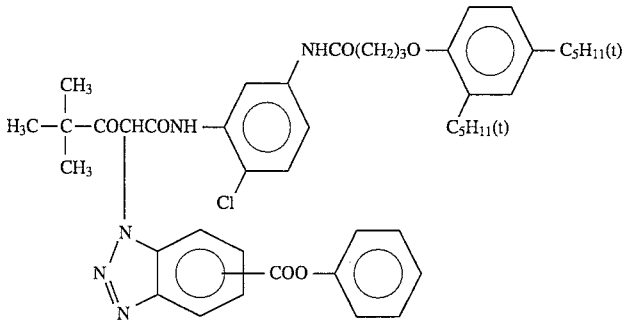
ExF-1
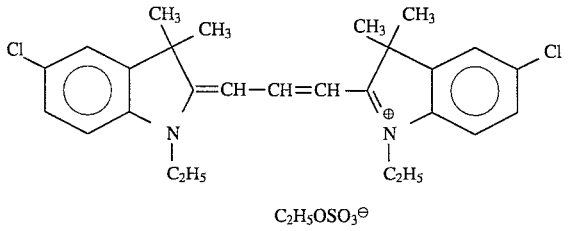
Cpd-1
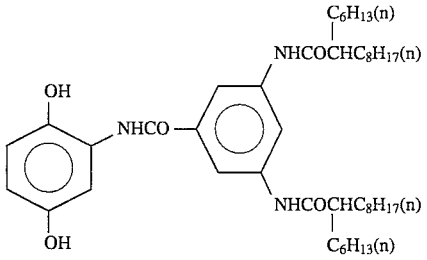
Cpd-2
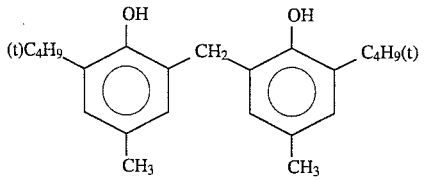
Cpd-3
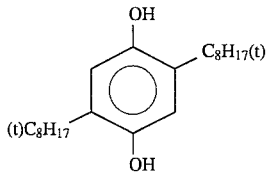
UV-1
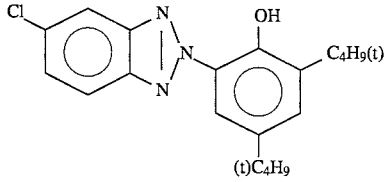
UV-2
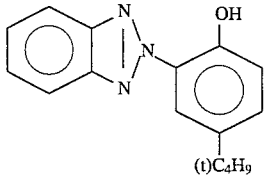

-continued
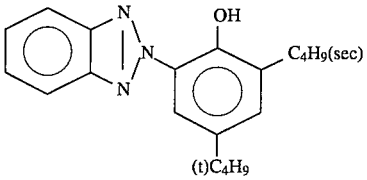
UV-3
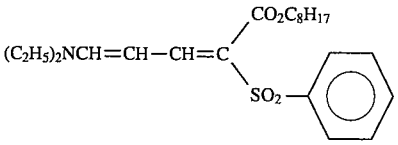
UV-4
tricresyl phosphate HBS-1
di-n-butyl phthalate HBS-2
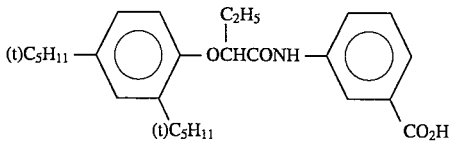
HBS-3
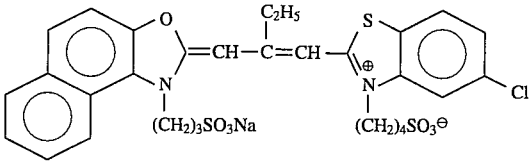
ExS-1
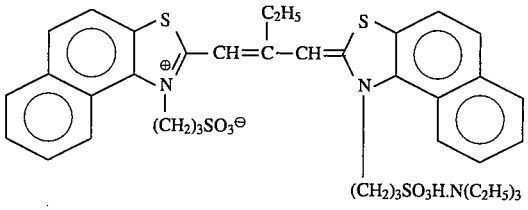
ExS-2
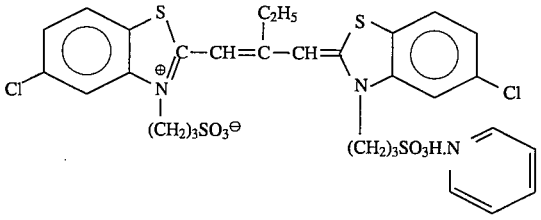
ExS-3
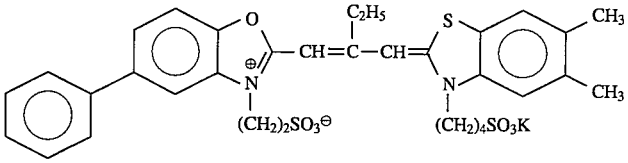
ExS-4
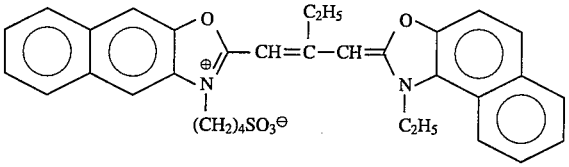
ExS-5

-continued
ExS-6
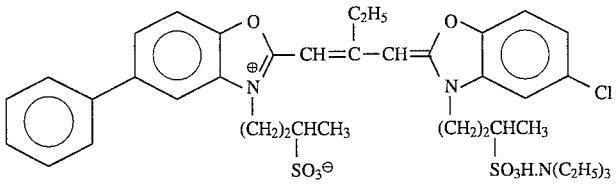
ExS-7
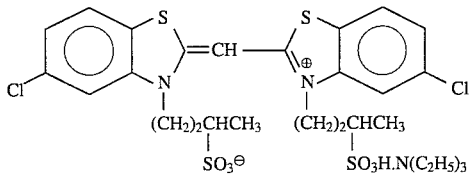
S-1
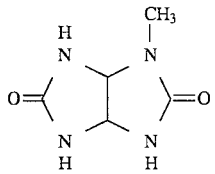
H-1
$CH_2{=}CH{-}SO_2{-}CH_2{-}CONH{-}CH_2$
$CH_2{=}CH{-}SO_2{-}CH_2{-}CONH{-}CH_2$
B-1
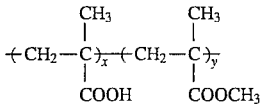
x/y = 10/90
B-2
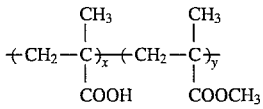
x/y = 40/60
B-3
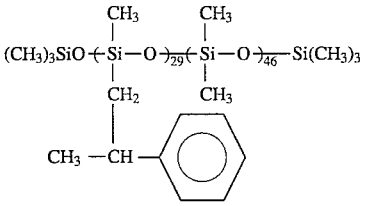
B-4
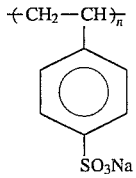
W-1
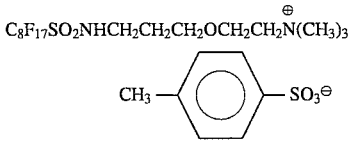
W-2
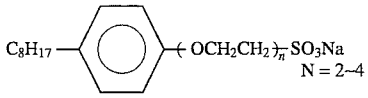
W-3
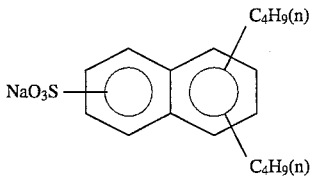

-continued
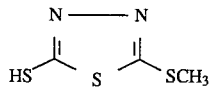
F-1
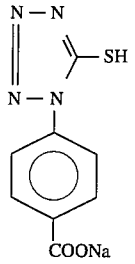
F-2
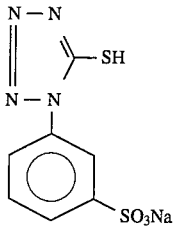
F-3
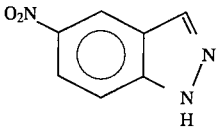
F-4
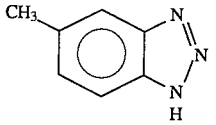
F-5
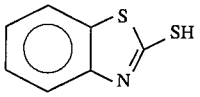
F-6
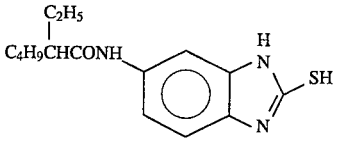
F-7
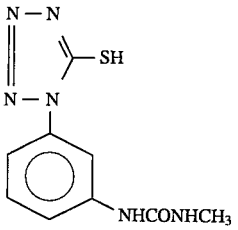
F-8
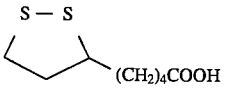
F-9
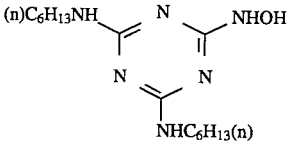
F-10

-continued
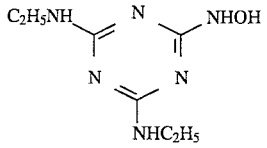
F-11
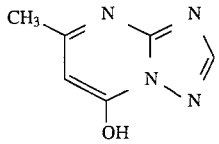
F-12
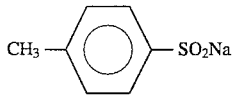
F-13
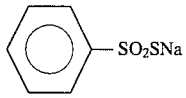
F-14
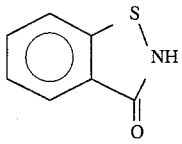
F-15
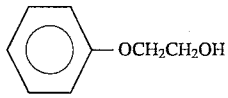
F-16
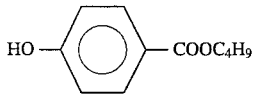
F-17
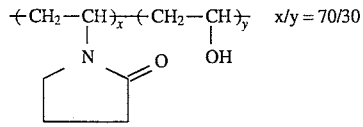
x/y = 70/30
B-5
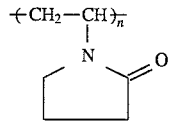
(mol. wt. 10,000 )
B-6
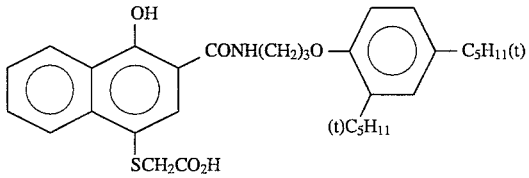
ExC-6
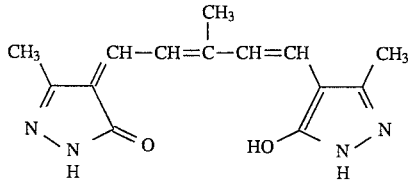
ExF-3
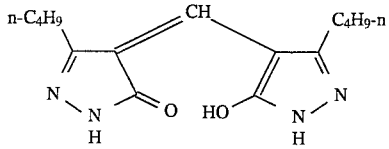
ExF-6

-continued

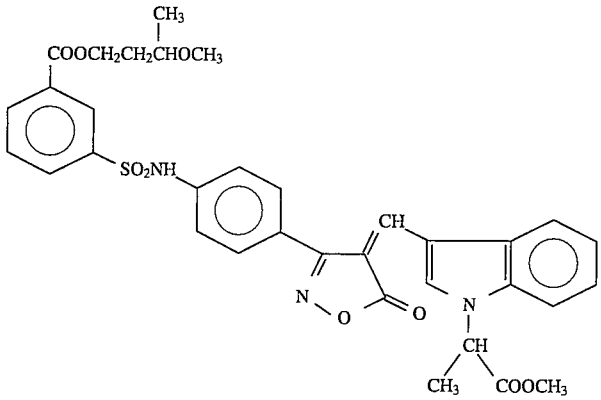

ExF-7

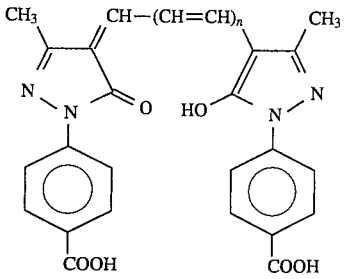

ExF-2 (n = 2)
ExF-4 (n = 1)
ExF-5 (n = 0)

Rapid development steps:

| Step | Temperature | Time |
|---|---|---|
| Color development | 40° C. | 180 sec |
| Bleach-fixing | 45° C. | 60 sec |
| Washing with water (1) | 40° C. | 15 sec |
| Washing with water (2) | 40° C. | 15 sec |
| Washing with water (3) | 40° C. | 15 sec |
| Stabilization | 40° C. | 15 sec |
| Drying | 80° C. | 30 sec |

[The washing with water was conducted with three tanks by counter-current method from (3) to (1).]

The description will be made on the composition of each solution:

| (Color developer) | Mother liquor (g) |
|---|---|
| Diethylenetriaminepentaacetic acid | 4.0 |
| 1-Hydroxyethylidene-1,1-diphosphonic acid | 3.0 |
| Sodium sulfite | 4.0 |
| Potassium carbonate | 50.0 |
| Potassium bromide | 4.0 |
| Potassium iodide | 1.3 mg |
| Monomethylhydroxylamine hydrochloride | 4.0 |
| 2-methyl-4-[N-ethyl-N-(β-hydroxyethyl)-amino]aniline sulfate (P-5) | 6.0 |
| Water | ad 1.0 l |
| pH (adjusted with potassium hydroxide and sulfuric acid | 10.05 |

| (Bleach-fixing bath) | (unit: mol) |
|---|---|
| Chelating agent of formula A | 0.17 |
| Ferric nitrate nonahydrate | 0.15 |
| Ammonium thiosulfate | 1.25 |
| Ammonium sulfite | 0.10 |

-continued

| | |
|---|---|
| Metacarboxybenzenesulfinic acid | 0.05 |
| Water | ad 1.0 l |
| pH (adjusted with acetic acid and ammonia) | 5.8 |

(Washing water)

Tap water was passed through a mixed bed column packed with an H-type strongly acidic cation exchange resin (Amberlite IR-120B; a product of Rohm & Haas Co.) and an OH-type anion exchange resin (Amberlite IR-400; a product of Rohm & Haas Co.) to reduce calcium and magnesium ion concentration to 3 mg/l or below, and then 20 mg/l of sodium isocyanurate dichloride and 0.15 g/l of sodium sulfate were added to the water. pH of the water was in the range of 6.5 to 7.5.

| (Stabilizing bath) | Mother liquor (g) |
|---|---|
| 1,2-Benzoisothiazoline-3-on | 0.1 |
| Polyoxyethylene p-monononylphenyl ether (average degree of polymerization: 10) | 0.2 |
| Water | ad 1.0 l |
| pH (adjusted with ammonia water and hydrochloric acid) | 8.50 |

Comparative processing steps:

(Processing method)

| Step | Time | Temp. |
|---|---|---|
| Color development | 3 min. 15 sec | 38° C. |
| Bleaching | 1 min 00 sec | 38° C. |
| Bleach-fixing | 3 min 15 sec | 38° C. |

| (Processing method) | | |
|---|---|---|
| Step | Time | Temp. |
| Washing with water (1) | 40 sec | 35° C. |
| Washing with water (2) | 1 min 00 sec | 35° C. |
| Stabilization | 40 sec | 38° C. |
| Drying | 1 min 15 sec | 55° C. |

The composition of each of the processing liquids was as follows:

| (Color developer) | Mother liquor (g) |
|---|---|
| Diethylenetriaminepentaacetic acid | 1.0 |
| 1-Hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl)amino]-2-methyl-aniline sulfate | 4.5 |
| Water | ad 1.0 l |
| pH (with potassium hydroxide and sulfuric acid) | 10.05 |

| (Bleaching bath) (common to mother liquor and replenisher) | (unit: g) |
|---|---|
| Ferric ammonium ethylenediaminetetraacetate dihydrate | 120.0 |
| Disodium ethylenediaminetetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2.2HCl$ | 0.005 mol |
| Ammonia water (27%) | 15.0 ml |
| Water | ad 1.0 l |
| pH (with ammonia water and nitric acid) | 6.3 |

| (Bleach-fixing bath) | Mother liquid (g) |
|---|---|
| Ferric ammonium ethylenediaminetetraacetate dihydrate | 50.0 |
| Disodium ethylenediaminetetraacetate | 5.0 |
| Sodium sulfite | 12.0 |
| Aqueous ammonium thiosulfate solution (700 g/l) | 240.0 ml |
| Ammonia water (27%) | 6.0 ml |
| Water | ad 1.0 l |
| pH (with ammonia water and acetic acid) | 7.2 |

(Washing water) (common to mother liquor and replenisher)

Tap water was passed through a mixed bed column packed with an H-type strongly acidic cation exchange resin (Amberlite IR-120B; a product of Rohm & Haas Co. ) and an OH-type anion exchange resin (Amberlite IR-400; a product of Rohm & Haas Co.) to reduce calcium and magnesium ion concentration to 3 mg/l or below, and then 20 mg/l of sodium isocyanurate dichloride and 0.15 g/l of sodium sulfate were added to the water. pH of the water was in the range of 6.5 to 7.5.

| (Stabilizing bath) (common to mother liquor and replenisher) | (init: g) |
|---|---|
| Sodium p-toluenesulfinate | 0.03 |
| Polyoxyethylene p-monononylphenyl ether (average degree of polymerization: 10) | 0.2 |
| Disodium ethylenediaminetetraacetate | 0.05 |
| 1,2,4-Triazole | 1.3 |

| (Stabilizing bath) (common to mother liquor and replenisher) | (init: g) |
|---|---|
| 1,4-Bis(1,2,4-triazol-1-ylmethyl)piperazine | 0.75 |
| Water | ad 1.0 l |
| pH | 8.5 |

Formula A:

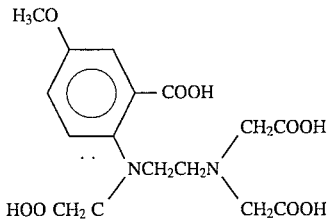

(Evaluation of photographic properties)

After wedge-exposure of the sample 101, the above-described rapid process was conducted (process 201) while the color development time was changed stepwise from 1 minute to 3 minutes at intervals of 10 seconds. The rapid process was conducted with a color developer which was the same as the above-described one except that the color developing agent (P-5 sulfate) in the color developer was replaced with a comparative color developing agent or color developing agent of the present invention. The optical densities of the yellow, magenta and cyan images of each of the resultant samples were determined. Then, after the wedge-exposure of the sample 101 conducted in the same manner as that described above, it was processed in comparative developing steps described above, and the optical densities of the yellow, magenta and cyan images were determined in the same manner as that described above. The density curve of the magenta image was compared with that of each sample (obtained at intervals of 10 seconds as described above), and the processing time in which the equal or higher magenta density was obtained was measured to obtain the results shown in Table 2.

Then the degree of lowering of the density of each of the yellow and cyan images was determined by using a sample processed for the time period for obtaining the same magenta density in the comparative developing method. The yellow and cyan densities of each sample were determined with such an exposure that magenta density of 2.0 would be obtained. The densities [minus (−) means lowering of the density and plus (+) means increase thereof] are given in Table 2 as compared with the yellow and cyan densities obtained in the comparative developing steps.

Comparative developing agent:

(Comparative Compound-1)

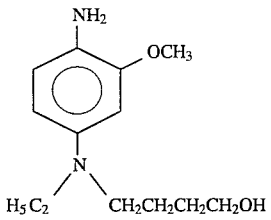

-continued (Comparative Compound-2)

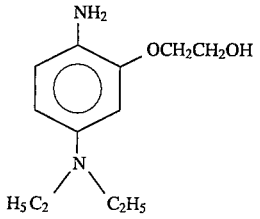

(Comparative Compound-3)

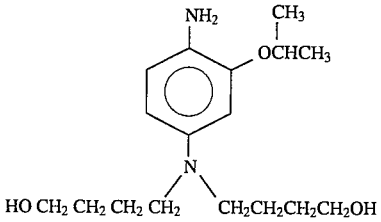

(Comparative Compound-4)

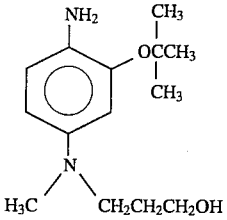

TABLE 2

| Process No. | Color developing agent | Process time |
|---|---|---|
| 201 | P-5 (Comp. Ex.) | 2 min 40 sec |
| 202 | Comp. compound-1 | 1 min 40 sec |
| 203 | Comp. compound-2 | 1 min 40 sec |
| 204 | Comp. compound-3 | 1 min 50 sec |
| 205 | Comp. compound-4 | 2 min 00 sec |
| 206 | D-1 (present invention) | 1 min 50 sec |
| 207 | D-2 (present invention) | 1 min 30 sec |
| 208 | D-5 (present invention) | 1 min 50 sec |
| 209 | D-14 (present invention) | 1 min 40 sec |
| 210 | D-17 (present invention) | 2 min 00 sec |
| 211 | D-18 (present invention) | 2 min 00 sec |
| 212 | D-20 (present invention) | 1 min 40 sec |
| 213 | D-23 (present invention) | 1 min 50 sec |

| Process No. | Difference in yellow density | Difference in cyan density | Number of OH | Number of C in $R_1$ to $R_5$ |
|---|---|---|---|---|
| 201 | +0.04 | −0.02 | | |
| 202 | −0.61 | −0.30 | 1 | 6 |
| 203 | −0.55 | −0.26 | 1 | 5 |
| 204 | −0.53 | −0.32 | 2 | 10 |
| 205 | −0.43 | −0.23 | 1 | 7 |
| 206 | −0.10 | −0.07 | 1 | 4 |
| 207 | −0.21 | −0.12 | 1 | 6 |
| 208 | −0.05 | +0.07 | 1 | 5 |
| 209 | −0.17 | −0.05 | 2 | 8 |
| 210 | −0.19 | −0.11 | 2 | 9 |
| 211 | −0.07 | −0.08 | 2 | 8 |
| 212 | −0.03 | 0.00 | 2 | 6 |
| 213 | +0.02 | −0.03 | 2 | 9 |

The following facts were understood from Table 2: with the alkoxyl group-containing color developing agent of the present invention or with the comparative compounds 1 to 4, the magenta image density can be obtained in a development time shorter than that necessitated for the development of methyl group-containing P-5 (No. 201). It will be noted, however, that with the comparative compounds 1 to 4, the yellow density and cyan density are not easily obtained, though they are really suitable for the rapid process. With the compound of the present invention, the yellow density and cyan density can be prevented from lowering by reducing the number of the total carbon atoms in $R_1$, $R_2$, $R_3$, $R_4$ and $R_5$, which are substituted with at least one hydroxyl group. Namely, when the number of hydroxyl group is one, the total carbon atoms in $R_1$ to $R_5$ is 4 to 6; when it is two, the total carbon atoms in $R_1$ to $R_5$ is 4 to 9; when it is three or more, the total carbon atoms in $R_1$ to $R_5$ is 4 to 20.

EXAMPLE 2

(Evaluation of oxidation stability)

The developer prepared in Example 1 was fed into a 1,000 ml beaker having a rotator. The beaker was covered with a Saran wrap. A hole having a diameter of 2 mm was made in the cover, and the developer was stirred with a magnetic stirrer at room temperature for 10 days. Then the developing agent residue was determined by HPLC to calculate the remaining rate. The results are given in Table 3.

After wedge-exposure of the sample 101, the rapid development process was conducted with the developer, which had been prepared as described above and stored for 10 days, for a time necessitated for attaining the same magenta density as that described above. The magenta, yellow and cyan densities of each sample was determined with such an exposure that a magenta density of 2.0 was attained with the fresh developer. The density reduction is given in Table 3.

TABLE 3

| Process No. | Color developing agent | Remaining rate |
|---|---|---|
| 301 | P-5 (Comp. Ex.) | 99% |
| 302 | Comp. compound-1 | 62% |
| 303 | Comp. compound-2 | 71% |
| 304 | Comp. compound-3 | 90% |
| 305 | Comp. compound-4 | 93% |
| 306 | D-1 (present invention) | 95% |
| 307 | D-2 (present invention) | 98% |
| 308 | D-5 (present invention) | 97% |
| 309 | D-14 (present invention) | 96% |
| 310 | D-17 (present invention) | 98% |
| 311 | D-18 (present invention) | 99% |
| 312 | D-20 (present invention) | 96% |
| 313 | D-23 (present invention) | 97% |

| Process No. | Difference in yellow density | Difference in cyan density | Difference in magenta density |
|---|---|---|---|
| 301 | +0.05 | −0.03 | −0.01 |
| 302 | −0.95 | −0.80 | −0.52 |
| 303 | −0.82 | −0.58 | −0.45 |
| 304 | −0.58 | −0.44 | −0.15 |
| 305 | −0.46 | −0.27 | −0.09 |
| 306 | −0.17 | −0.13 | −0.03 |
| 307 | −0.25 | −0.13 | −0.02 |
| 308 | −0.15 | +0.02 | −0.04 |
| 309 | −0.20 | −0.09 | −0.05 |
| 310 | −0.21 | −0.15 | −0.03 |
| 311 | −0.11 | −0.10 | +0.01 |
| 312 | −0.15 | −0.02 | −0.07 |
| 313 | −0.05 | +0.05 | −0.03 |

The following facts were understood from Table 3: a color developing agent having methoxy group or 2-hydroxyethoxy group as the alkoxyl group is more rapidly deteriorated than that having methyl group (comparative compound 2 or 3). However, when the compound of the present invention is used, the deterioration of the color developing agent can be controlled, the yellow density and cyan density can be prevented from lowering, and excellent photographic properties can be obtained even with the developer which has been stored. Namely, such advantages are obtained with the compound of the present invention having a primary or secondary alkoxyl group and a reduced number of the total carbon atoms in $R_1$, $R_2$, $R_3$, $R_4$ and $R_5$, which are substituted with at least one hydroxyl group. In particular, when the number of hydroxyl group is one, the total carbon atoms in $R_1$ to $R_5$ is 4 to 6; when it is two, the total carbon atoms in $R_1$ to $R_5$ is 4 to 9; and when it is three or more, the total carbon atoms in $R_1$ to $R_5$ is 4 to 20.

Thus, when the color developing agent of the present invention suitable for the rapid process is used, the deterioration of the developer with time is only slight, and an image having sufficient yellow, magenta and cyan image densities can be obtained.

What is claimed is:

1. A method for forming a color image which comprises the step of developing an image-wise exposed silver halide color photographic photosensitive material in the presence of a color developing agent represented by the following formula (D):

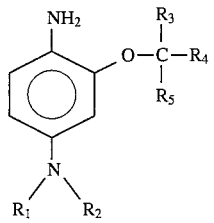

(D)

wherein $R_1$ and $R_2$ each represent an alkyl group, $R_3$, $R_4$ and $R_5$ may be the same or different from one another and each represent a hydrogen atom or substituent, with the proviso that at least two of $R_3$, $R_4$ and $R_5$ each represent an alkyl, aryl, heterocyclic, carboxyl, acyl or carbamoyl group, $R_1$, $R_2$, $R_3$, $R_4$ and $R_5$ may be substituted and are substituted with at least one hydroxyl group, when the number of the hydroxyl group is one, the total carbon atoms in $R_1$ through $R_5$ is 4 to 6; when the number of the hydroxyl groups is two, the number of the total carbon atoms in $R_1$ through $R_5$ is 4 to 9; and when the number of the hydroxyl groups is three to six, the number of the total carbon atoms in $R_1$ through $R_5$ is 4 to 20.

2. The method of claim 1 wherein $R_1$, $R_2$, $R_3$, $R_4$ and $R_5$ may have a substituent selected from the group consisting of halogen atoms, alkyl, aryl, heterocyclic, cyano, nitro, hydroxy, carboxyl, sulfo, alkoxy, aryloxy, acylamino, amino, alkylamino, anilino, ureido, sulfamoylamino, alkylthio, arylthio, alkoxycarbonylamino, sulfonamido, carbamoyl, sulfamoyl, sulfonyl, alkoxycarbonyl, heterocyclic-oxy, azo, acyloxy, carbamoyloxy, silyl, silyloxy, aryloxycarbonylamino, imido, heterocyclic-thio, sulfinyl, phosphonyl, aryloxycarbonyl and acyl groups.

3. The method of claim 1 wherein $R_1$ and $R_2$ each is a substituted or unsubstituted straight, branched or cyclic alkyl group having 1 to 6 carbon atoms and $R_3$, $R_4$ and $R_5$ each is a hydrogen atom, alkyl group having 1 to 6 carbon atoms, carboxyl group, acyl group having 1 to 6 carbon atoms or carbamoyl group, which may be substituted.

4. The method of claim 1 wherein $R_1$ and $R_2$ each is an unsubstituted straight or branched alkyl group having 1 to 6 carbon atoms or a straight or branched alkyl group having 1 to 6 carbon atoms substituted with a hydroxyl group, carboxyl group, sulfo group or sulfonamido group.

5. The method of claim 1 wherein $R_3$, $R_4$ and $R_5$ each is a hydrogen atom, unsubstituted alkyl group having 1 to 6 carbon atoms or an alkyl group having 1 to 6 carbon atoms substituted with a hydroxyl group, carboxyl group, sulfo group or sulfonamido group.

6. The method of claim 1 wherein $R_1$ and $R_2$ each is an unsubstituted straight or branched alkyl group having 1 to 6 carbon atoms or a straight or branched alkyl group having 1 to 6 carbon atoms substituted with a hydroxyl group, carboxyl group, sulfo group or sulfonamido group, $R_3$, $R_4$ and $R_5$ each is a hydrogen atom, an alkyl group having 1 to 6 carbon atoms and at least one of $R_3$, $R_4$ and $R_5$ is a substituted alkyl group.

7. The method of claim 1 wherein $R_1$ and $R_2$ each is an unsubstituted straight or branched alkyl group having 1 to 6 carbon atoms or a straight or branched alkyl group having 1 to 6 carbon atoms substituted with a hydroxyl group, carboxyl group, sulfo group or sulfonamido group, $R_3$, $R_4$ and $R_5$ each is a hydrogen atom, an alkyl group having 1 to 6 carbon atoms, carboxy, acyl having 1 to 6 carbon atoms or carbamoyl group and at least one of $R_3$, $R_4$ and $R_5$ is a carboxy, acyl having 1 to 6 carbon atoms or carbamoyl group.

8. The method of claim 1 wherein $R_1$ and $R_2$ each is an unsubstituted straight or branched alkyl group having 1 to 6 carbon atoms or a straight or branched alkyl group having 1 to 6 carbon atoms substituted with a hydroxyl group, carboxyl group, sulfo group or sulfonamido group, $R_3$, $R_4$ and $R_5$ each is a hydrogen atom, unsubstituted alkyl group having 1 to 6 carbon atoms or an alkyl group having 1 to 6 carbon atoms substituted with a hydroxyl group, carboxyl group, sulfo group or sulfonamido group, provided that when the number of the hydroxyl group is one, the total carbon atoms in $R_1$ through $R_5$ is 4 to 5; when the number of the hydroxyl groups is two, the number of the total carbon atoms in $R_1$ through $R_5$ is 4 to 8; and when the number of the hydroxyl groups is three to five, the number of the total carbon atoms in $R_1$ through $R_5$ is 4 to 20.

9. The method of claim 1 wherein $R_1$ is an alkyl or hydroxy alkyl group having 1 to 6 carbon atoms, $R_2$ is an alkyl group having 1 to 6 carbon atoms which may be substituted by a hydroxyl group, carboxyl group, sulfo group or sulfonamido group, $R_3$ is an alkyl or hydroxy alkyl group having 1 to 6 carbon atoms, $R_4$ is an alkyl group having 1 to 6 carbon atoms which may be substituted by a hydroxyl group, carboxyl group, sulfo group or sulfonamido group, and $R_5$ is a hydrogen atom or an alkyl group having 1 to 6 carbon atoms.

10. The method of claim 1 wherein the development is carried out at a temperature of 35° to 50° C. for 30 seconds to three minutes and 15 seconds for photosensitive materials for photography.

11. The method of claim 1 wherein the development is carried out at a temperature of 20° to 50° C. for not longer than three minutes for photosensitive materials for print.

12. A method for forming a color image which comprises the step of developing an image-wise exposed silver halide color photographic photosensitive material in the presence of a color developing agent represented by the following formula (D) at a temperature of 20° to 50° C. for not longer than three minutes and 15 seconds:

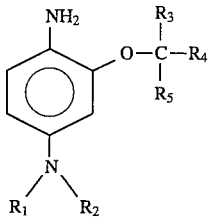

(D)

wherein $R_1$ is an alkyl or hydroxy alkyl group having 1 to 6 carbon atoms, $R_2$ is an alkyl group having 1 to 6 carbon atoms which may be substituted by a hydroxyl group, carboxyl group, sulfo group or sulfonamido group, $R_3$ is an alkyl or hydroxy alkyl group having 1 to carbon atoms, $R_4$ is an alkyl group having 1 to 6 carbon atoms which may be substituted by a hydroxyl group, carboxyl group, sulfo group or sulfonamido group, and $R_5$ is a hydrogen atom or an alkyl group having 1 to 6 carbon atoms, provided that when the number of the hydroxyl group is one, the total carbon atoms in $R_1$ through $R_5$ is 4 to 5; when the number of the hydroxyl groups is two, the number of the total carbon atoms in $R_1$ through $R_5$ is 4 to 8; and when the number of the hydroxyl groups is three to five, the number of the total carbon atoms in $R_1$ through $R_5$ is 4 to 20.

13. A color developing agent represented by the following formula (D):

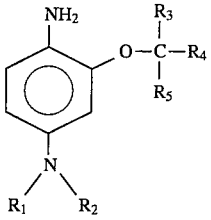

(D)

wherein $R_1$ and $R_2$ each represent an alkyl group, $R_3$, $R_4$ and $R_5$ may be the same or different from one another and each represent a hydrogen atom or substituent, with the proviso that at least two of $R_3$, $R_4$ and $R_5$ each represent an alkyl, aryl, heterocyclic, carboxyl, acyl or carbamoyl group, $R_1$, $R_2$, $R_3$, $R_4$ and $R_5$ may be substituted and are substituted with at least one hydroxyl group, when the number of the hydroxyl group is one, the total carbon atoms in $R_1$ through $R_5$ is 4 to 6; when the number of the hydroxyl groups is two, the number of the total carbon atoms in $R_1$ through $R_5$ is 4 to 9; and when the number of the hydroxyl groups is three to six, the number of the total carbon atoms in $R_1$ through $R_5$ is 4 to 20.

14. The color developing agent of claim 13 wherein $R_1$ and $R_2$ each is a substituted or unsubstituted straight, branched or cyclic alkyl group having 1 to 6 carbon atoms and $R_3$, $R_4$ and $R_5$ each is a hydrogen atom, alkyl group having 1 to 6 carbon atoms, carboxyl group, acyl group having 1 to 6 carbon atoms or carbamoyl group, which may be substituted.

15. The color developing agent of claim 13 wherein $R_1$ and $R_2$ each is an unsubstituted straight or branched alkyl group having 1 to 6 carbon atoms or a straight or branched alkyl group having 1 to 6 carbon atoms substituted with a hydroxyl group, carboxyl group, sulfo group or sulfonamido group, $R_3$, $R_4$ and $R_5$ each is a hydrogen atom, unsubstituted alkyl group having 1 to 6 carbon atoms or an alkyl group having 1 to 6 carbon atoms substituted with a hydroxyl group, carboxyl group, sulfo group or sulfonamido group, provided that when the number of the hydroxyl group is one, the total carbon atoms in $R_1$ through $R_5$ is 4 to 5; when the number of the hydroxyl groups is two, the number of the total carbon atoms in $R_1$ through $R_5$ is 4 to 8; and when the number of the hydroxyl groups is three to five, the number of the total carbon atoms in $R_1$ through $R_5$ is 4 to 20.

16. The color developing agent of claim 13 wherein $R_1$ is an alkyl or hydroxy alkyl group having 1 to 6 carbon atoms, $R_2$ is an alkyl group having 1 to 6 carbon atoms which may be substituted by a hydroxyl group, carboxyl group, sulfo group or sulfonamido group, $R_3$ is an alkyl or hydroxy alkyl group having 1 to 6 carbon atoms, $R_4$ is an alkyl group having 1 to 6 carbon atoms which may be substituted by a hydroxyl group, carboxyl group, sulfo group or sulfonamido group, and $R_5$ is a hydrogen atom or an alkyl group having 1 to 6 carbon atoms.

17. A processing solution for developing silver halide color photographic materials which comprises a color developing agent of claim 13 and a balance of water.

* * * * *